US007794072B2

(12) United States Patent
Esplin et al.

(10) Patent No.: US 7,794,072 B2
(45) **Date of Patent: *Sep. 14, 2010**

(54) GUIDE FOR PRINTER SOLID INK TRANSPORT AND METHOD

(75) Inventors: Ernest Isreal Esplin, Sheridan, OR (US); Michael Alan Fairchild, Vancouver, WA (US)

(73) Assignee: Xerox Corporation, Norwalk, CT (US)

( * ) Notice: Subject to any disclaimer, the term of this patent is extended or adjusted under 35 U.S.C. 154(b) by 761 days.

This patent is subject to a terminal disclaimer.

(21) Appl. No.: 11/602,937

(22) Filed: Nov. 21, 2006

(65) Prior Publication Data

US 2008/0117265 A1 May 22, 2008

(51) Int. Cl.
*B41J 2/175* (2006.01)

(52) U.S. Cl. ..... 347/88; 347/99; 347/103

(58) Field of Classification Search ..... 347/88, 347/99, 103

See application file for complete search history.

(56) References Cited

U.S. PATENT DOCUMENTS

| | | | | |
|---|---|---|---|---|
| 3,656,360 | A | | 4/1972 | Fix |
| 4,636,803 | A | | 1/1987 | Mikalsen |
| 5,123,961 | A | | 6/1992 | Yamamoto |
| 5,181,049 | A | * | 1/1993 | Mackay et al. ..... 347/88 |
| 5,223,860 | A | | 6/1993 | Loofbourow et al. |
| 5,276,468 | A | | 1/1994 | Deur et al. |
| 5,341,164 | A | | 8/1994 | Miyazawa et al. |
| 5,386,224 | A | | 1/1995 | Deur et al. |
| 5,442,387 | A | | 8/1995 | Loofbourow et al. |
| 5,510,821 | A | | 4/1996 | Jones et al. |
| D371,157 | S | | 6/1996 | Chambers |
| D371,801 | S | | 7/1996 | Jones et al. |
| D371,802 | S | | 7/1996 | Jones et al. |
| D372,268 | S | | 7/1996 | Jones et al. |
| D372,270 | S | | 7/1996 | Jones et al. |
| D373,139 | S | | 8/1996 | Jones et al. |

(Continued)

FOREIGN PATENT DOCUMENTS

EP 0683051 A2 11/1995

(Continued)

OTHER PUBLICATIONS

Non-Final Office Action for U.S. Appl. No. 11/602,710 Mailed Aug. 11, 2009, United States Patent and Trademark Office (7 pages).

(Continued)

*Primary Examiner*—Manish S Shah
(74) *Attorney, Agent, or Firm*—Maginot, Moore & Beck LLP

(57) ABSTRACT

A solid ink delivery system for use with a solid ink stick for use in solid ink printers is provided. The solid ink delivery system is used for delivering the stick to a melting station for melting the stick so that the ink may be transferred to media to form an image on the media. The delivery system includes a guide for guiding the stick in a prescribed path. The guide defines a loading position to permit the stick to be placed in the guide and a delivery position adjacent the melt station. The stick advances from the loading position to the delivery position in the prescribed path and a portion of the prescribed path is arcuate.

16 Claims, 21 Drawing Sheets

U.S. PATENT DOCUMENTS

D379,470 S 5/1997 Gilbert
D379,471 S 5/1997 Gilbert
D379,639 S 6/1997 Gilbert
D379,640 S 6/1997 Gilbert
D380,771 S 7/1997 Jones
D383,153 S 9/1997 Jones et al.
D383,154 S 9/1997 Jones et al.
5,689,288 A 11/1997 Wimmer et al.
5,734,402 A 3/1998 Rousseau et al.
5,784,089 A 7/1998 Crawford
D402,308 S 12/1998 Yao et al.
D403,351 S 12/1998 Yao et al.
D403,352 S 12/1998 Brown et al.
D403,699 S 1/1999 Chin et al.
5,861,903 A 1/1999 Crawford et al.
D407,109 S 3/1999 Yao et al.
D407,110 S 3/1999 Yao et al.
D407,111 S 3/1999 Brown et al.
D407,742 S 4/1999 Yao et al.
D407,743 S 4/1999 Yao et al.
D407,745 S 4/1999 Brown et al.
D408,849 S 4/1999 Chin et al.
D409,235 S 5/1999 Chin et al.
D409,237 S 5/1999 Ellers et al.
D410,026 S 5/1999 Brown et al.
D410,490 S 6/1999 Mattern et al.
5,917,528 A 6/1999 Grellmann et al.
D412,527 S 8/1999 Ellers et al.
D412,528 S 8/1999 Ellers et al.
D412,934 S 8/1999 Jones
D413,625 S 9/1999 Brown et al.
D414,200 S 9/1999 Jones
D415,193 S 10/1999 Jones
D416,936 S 11/1999 Chin et al.
5,975,690 A 11/1999 Grellmann et al.
5,988,805 A 11/1999 Meinhardt
6,053,608 A 4/2000 Ishii et al.
6,056,394 A 5/2000 Rousseau et al.
6,109,803 A 8/2000 Yasui et al.
D436,124 S 1/2001 Mattern et al.
D436,989 S 1/2001 Mattern et al.
D440,248 S 4/2001 Mattern et al.
D440,249 S 4/2001 Ellers et al.
D453,786 S 2/2002 Mattern
D453,787 S 2/2002 Mattern
6,422,694 B1 7/2002 Hollands
6,543,867 B1 4/2003 Jones
6,561,636 B1 5/2003 Jones
6,565,200 B1 5/2003 Jones
6,565,201 B1 5/2003 Jones
6,572,225 B1 6/2003 Jones
D478,347 S 8/2003 Jones
D478,621 S 8/2003 Jones
D479,368 S 9/2003 Jones
D481,757 S 11/2003 Jones
D481,758 S 11/2003 Jones
D481,759 S 11/2003 Jones et al.
D482,062 S 11/2003 Jones
D482,063 S 11/2003 Jones et al.
D482,388 S 11/2003 Jones
D482,389 S 11/2003 Jones
D482,720 S 11/2003 Jones et al.
D482,721 S 11/2003 Jones
D482,722 S 11/2003 Jones
6,648,435 B1 11/2003 Jones
D483,062 S 12/2003 Jones
D483,063 S 12/2003 Jones
D483,404 S 12/2003 Jones et al.
6,672,716 B2 1/2004 Jones
6,679,591 B2 1/2004 Jones
6,705,710 B2 3/2004 Jones et al.
6,709,094 B2 3/2004 Jones
6,719,413 B2 4/2004 Jones
6,719,419 B2 4/2004 Jones et al.
6,722,764 B2 4/2004 Jones et al.
6,739,713 B2 * 5/2004 Jones et al. ..... 347/88
6,746,113 B1 6/2004 Leighton et al.
6,755,517 B2 6/2004 Jones et al.
6,761,443 B2 7/2004 Jones
6,761,444 B2 * 7/2004 Jones et al. ..... 347/88
6,772,764 B2 8/2004 Chapman
6,824,241 B2 11/2004 Sonnichsen et al.
6,840,612 B2 * 1/2005 Jones et al. ..... 347/88
6,840,613 B2 1/2005 Jones
6,857,732 B2 2/2005 Jones et al.
6,866,375 B2 3/2005 Leighton et al.
6,874,880 B2 4/2005 Jones
6,893,121 B2 5/2005 Jones
6,895,191 B2 5/2005 Rommelmann et al.
6,905,201 B2 6/2005 Leighton
6,929,360 B2 8/2005 Jones
6,966,644 B2 11/2005 Jones et al.
6,981,754 B2 1/2006 Godil et al.
6,986,570 B2 1/2006 Jones et al.
7,063,412 B2 6/2006 Jones et al.
7,066,589 B2 6/2006 Jones et al.
7,104,635 B2 9/2006 Jones
2003/0202066 A1 10/2003 Jones
2003/0202067 A1 10/2003 Jones et al.
2003/0202069 A1 10/2003 Jones
2003/0202070 A1 10/2003 Jones
2003/0202071 A1 10/2003 Jones et al.
2003/0202074 A1 10/2003 Jones
2003/0202075 A1 10/2003 Jones
2003/0202077 A1 10/2003 Jones et al.
2003/0222930 A1 12/2003 Jones
2003/0222951 A1 12/2003 Jones
2003/0222952 A1 12/2003 Jones
2003/0222953 A1 12/2003 Jones
2003/0222954 A1 12/2003 Jones et al.
2003/0222955 A1 12/2003 Jones
2004/0160498 A1 8/2004 Jones
2004/0179074 A1 9/2004 Jones et al.
2004/0183875 A1 9/2004 Jones et al.
2005/0007428 A1 1/2005 Joppen
2005/0063820 A1 3/2005 Awdalla
2005/0146584 A1 7/2005 Godil et al.
2005/0151814 A1 7/2005 Wong et al.
2007/0153068 A1 7/2007 Jones et al.
2008/0088688 A1 4/2008 Jones et al.
2008/0122907 A1 5/2008 Jones

FOREIGN PATENT DOCUMENTS

EP 1122075 A1 8/2001
EP 1359019 A1 5/2003
JP 11115213 4/1999

OTHER PUBLICATIONS

Amendment in Response to Non-Final Office Action for U.S. Appl. No. 11/602,710 Submitted Nov. 12, 2009 (13 pages).
Final Office Action for U.S. Appl. No. 11/602,710 Mailed Mar. 5, 2010 United States Patent and Trademark Office (7 pages).
Amendment accompanying a Request for Continued Examination for U.S. Appl. No. 11/602,710 Submitted Apr. 23, 2010 (5 pages).
Non-Final Office Action for U.S. Appl. No. 11/602,931 Mailed Jun. 9, 2009, United States Patent and Trademark Office (21 pages).
Amendment in Response to Non-Final Office Action for U.S. Appl. No. 11/602,931 Submitted Sep. 8, 2009 (17 pages).
Final Office Action for U.S. Appl. No. 11/602,931 Mailed Jan. 5, 2010, United States Patent and Trademark Office (21 pages).
Amendment accompanying a Request for Continued Examination for U.S. Appl. No. 11/602,931 Submitted Apr. 5, 2010 (9 pages).

Non-Final Office Action for U.S. Appl. No. 11/602,938 Mailed Aug. 7, 2009, United States Patent and Trademark Office (10 pages).
Amendment in Response to Non-Final Office Action for U.S. Appl. No. 11/602,938, submitted Sep. 2, 2009 (29 pages).
Non-Final Office Action for U.S. Appl. No. 11/602,943 Mailed Jun. 25, 2009, United States Patent and Trademark Office (7 pages).
Amendment in Response to Non-Final Office Action for U.S. Appl. No. 11/602,943, submitted Sep. 24, 2009 (13 pages).
Final Office Action for U.S. Appl. No. 11/602,943 Mailed Jan. 21, 2010, United States Patent and Trademark Office (9 pages).
Amendment accompanying a Request for Continued Examination for U.S. Appl. No. 11/602,943, submitted Mar. 22, 2010 (10 pages).
Second Non-Final Office Action for U.S. Appl. No. 11/602,943 Mailed Apr. 14, 2010, United States Patent and Trademark Office (5 pages).
Amendment in Response to second Non-Final Office Action for U.S. Appl. No. 11/602,943, submitted Apr. 23, 2010 (10 pages).
International Search Report in corresponding European Application No. 07120873.0 mailed May 19, 2008 (9 pages).
International Search Report in corresponding European Application No. 07120873.0 mailed Mar. 4, 2008 (5 pages).
International Search Report in corresponding European Application No. 07120975.3 mailed Mar. 14, 2008 (5 pages).

* cited by examiner

GUIDE FOR PRINTER SOLID INK TRANSPORT AND METHOD

1. CROSS-REFERENCE TO RELATED APPLICATIONS

Cross reference is made to the following applications: 1776-0091 titled, "Transport System for Solid Ink in a Printer", having Ser. No. 11/602,943, 1776-0092 titled "Printer Solid Ink Transport and Method", having Ser. No. 11/602,931, 1776-0102 titled "Solid Ink Stick Features for Printer Ink Transport and Method", having Ser. No. 11/602,710, and 1776-0133 titled "Transport System for Solid Ink for Cooperation with Melt Head in a Printer", having Ser. No. 11/602,938, filed concurrently herewith which are incorporated herein by reference.

2. TECHNICAL FIELD

The guide described herein generally relates to high speed printers which have one or more printheads that receive molten ink heated from solid ink sticks or pellets. More specifically, the guide relates to improving the ink transport system design and functionality.

3. BACKGROUND OF RELATED ART

So called "solid ink" printers encompass various imaging devices, including printers and multi-function platforms and offer many advantages over many other types of high speed or high output document reproduction technologies such as laser and aqueous inkjet approaches. These often include higher document throughput (i.e., the number of documents reproduced over a unit of time), fewer mechanical components needed in the actual image transfer process, fewer consumables to replace, sharper images, as well as being more environmentally friendly (far less packaging waste).

A schematic diagram for a typical solid ink imaging device is illustrated in FIG. 1. The solid ink imaging device, hereafter simply referred to as a printer 100 has an ink loader 110 which receives and stages solid ink sticks which remain in solid form at room temperatures. The ink stock can be refilled by a user by simply adding more ink as needed to the ink loader 110. Separate loader channels are used for the different colors. For, example, only black solid ink is needed for monochrome printing, while solid ink colors of black, cyan, yellow and magenta are typically needed for color printing. Each color is loaded and fed in independent channels of the ink loader.

An ink melt unit 120 melts the ink by raising the temperature of the ink sufficiently above its melting point. During a melting phase of operation, the leading end of an ink stick contacts a melt plate or heated surface of the melt unit and the ink is melted in that region. The liquefied ink is supplied to a single or group of print heads 130 by gravity, pump action, or both. In accordance with the image to be reproduced, and under the control of a printer controller (not shown), a rotating print drum 140 receives ink droplets representing the image pixels to be transferred to paper or other media 170 from a sheet feeder 160. To facilitate the image transfer process, a pressure roller 150 presses the media 170 against the print drum 140, whereby the ink is transferred from the print drum to the media. The temperature of the ink can be carefully regulated so that the ink fully solidifies just after the image transfer.

While there may be advantages to the use of solid ink printers compared to other image reproduction technologies, high speed and voluminous printing sometimes creates problems not satisfactorily addressed by the prior art solid ink printing architectures. To meet the large ink volume requirement, ink loaders must have large storage capacity and be able to be replenished by loading ink at any time the loader has capacity for additional ink.

In typical prior art ink chuck or stick reservoirs, the sticks are positioned end to end in straight or linear channel or chute with a melt head on one end and a spring biased push stick on the other end. As these solid ink printers have high productivity rates, the storage of ample supplies of ink is very desirable. As the space in solid ink printers is limited, finding a location within the printer to accommodate a long straight chute for holding an ample supply of ink is a challenge. The amount of ink that can be accommodated is limited by the physical dimensions of the printer and can not be greater that the amount accommodated by a linear chute diagonally positioned in the printer.

4. SUMMARY

In view of the above-identified problems and limitations of the prior art and alternate ink and ink loader forms, a solid ink supply system is provided that is adapted for use with solid ink printers.

According to one embodiment, a solid ink delivery system for use with a solid ink stick for use in solid ink printers is provided. The solid ink delivery system is used for delivering the solid ink stick to a melting station for melting the solid ink stick so that the ink may be transferred to media to form an image on the media. The delivery system includes a guide for guiding the solid ink stick in a prescribed path. The guide defines a loading position to permit the stick to be placed in the guide and a delivery position adjacent the melt station. The stick advances from the loading position to the delivery position in the prescribed path and a portion of the prescribed path is arcuate.

According to another embodiment, a solid ink printer including a solid ink delivery system for use with a solid ink stick is provided. The solid ink delivery system delivers the solid ink stick to a melting station for melting the solid ink stick so that the ink may be transferred to media to form an image on the media. The delivery system includes a guide for guiding the solid ink stick in a prescribed path. The guide defines a loading position to permit the stick to be placed in the guide and defines a delivery position adjacent the melt station. The stick advances from the loading position to the delivery position in the prescribed path and a portion of the prescribed path is arcuate.

According to yet another embodiment, a solid ink stick adapted for use with solid ink printers having a curved loading device for receiving the stick and advancing the stick toward a melting station in the printer is provided. The stick includes a body defining a longitudinal axis of the body. The longitudinal axis is non linear and the stick is adapted to closely conform to a curved loading device.

As described herein, an ink delivery system for solid ink printers utilizes a curved chute to advance the ink from the loading station to the melting station to transfer ink to one or more printheads. The many additional described features of this ink delivery system, which can be selectively incorporated individually or in any combination, enable many additional printer system opportunities, including lower cost, enlarged ink storage capacity, as well as, less jamming and camming as an alternative (upgrade) or addition (volume/delivery supplement) to more typical ink delivery systems.

5. BRIEF DESCRIPTION OF THE DRAWINGS

Features of the system described herein will become apparent to those skilled in the art from the following description with reference to the drawings, in which.

Figure 26:
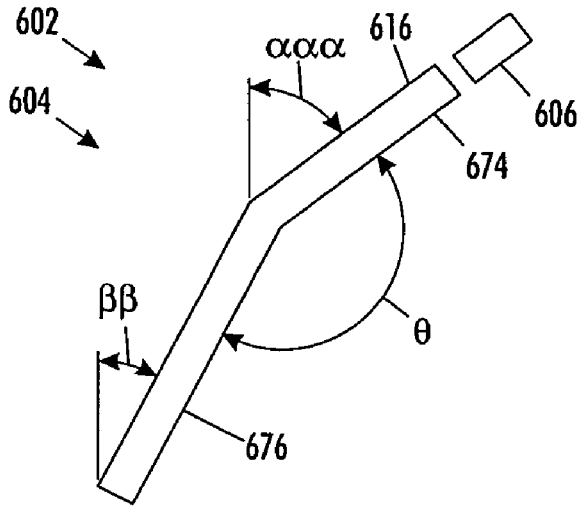
Figure 27:
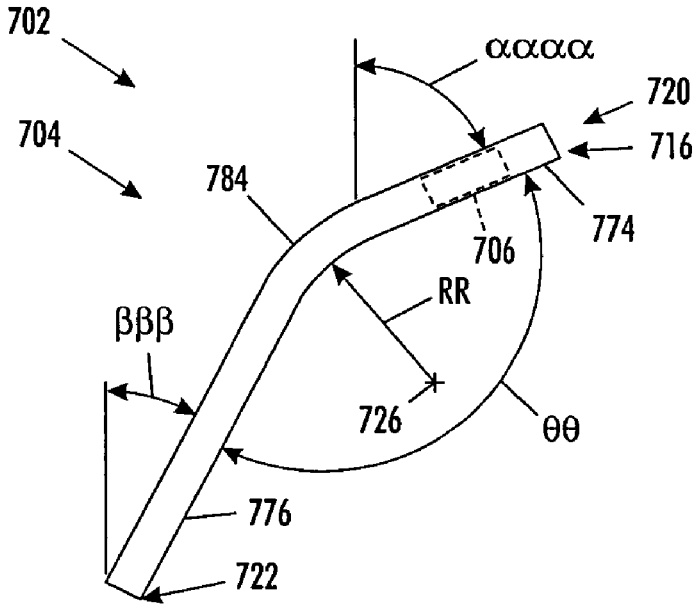

FIG. 26 is a plan view of a further embodiment of the solid ink delivery system in the form of a solid ink delivery system with a chute having a first linear portion and a second linear portion; and FIG. 27 is a plan view of a further embodiment of the solid ink delivery system in the form of a solid ink delivery system with a chute having a first linear portion, a curved portion and a second linear portion.

6. DETAILED DESCRIPTION

The term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of intermediate connections, tubes, manifolds and/or other components that may be involved in a printing system but are not immediately significant to the system described herein.

The general components of a solid ink printer have been described supra. The system described herein includes a solid ink delivery system and a solid ink printer and a solid ink stick for incorporating the same.

Figure 1:
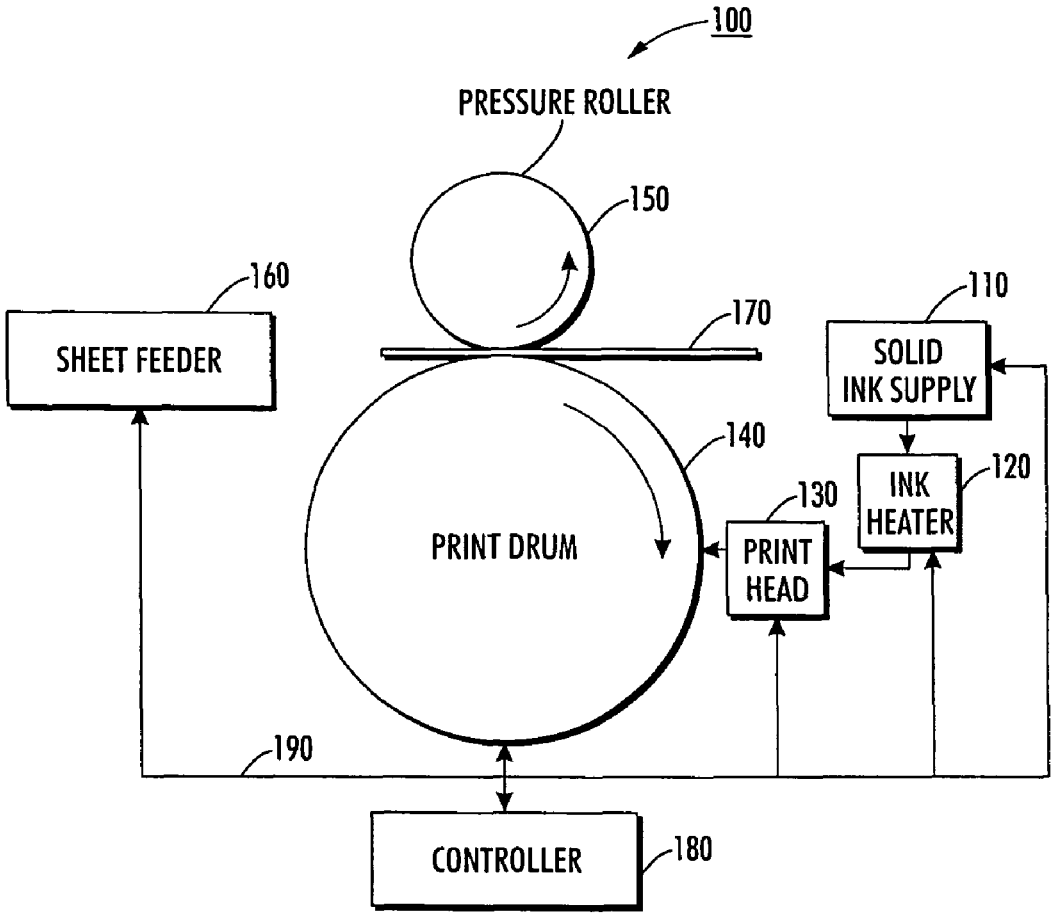
FIG. 1 PRIOR ART
FIG. 1 is a general schematic diagram of a prior art high speed, solid ink printer.
Figure 2:
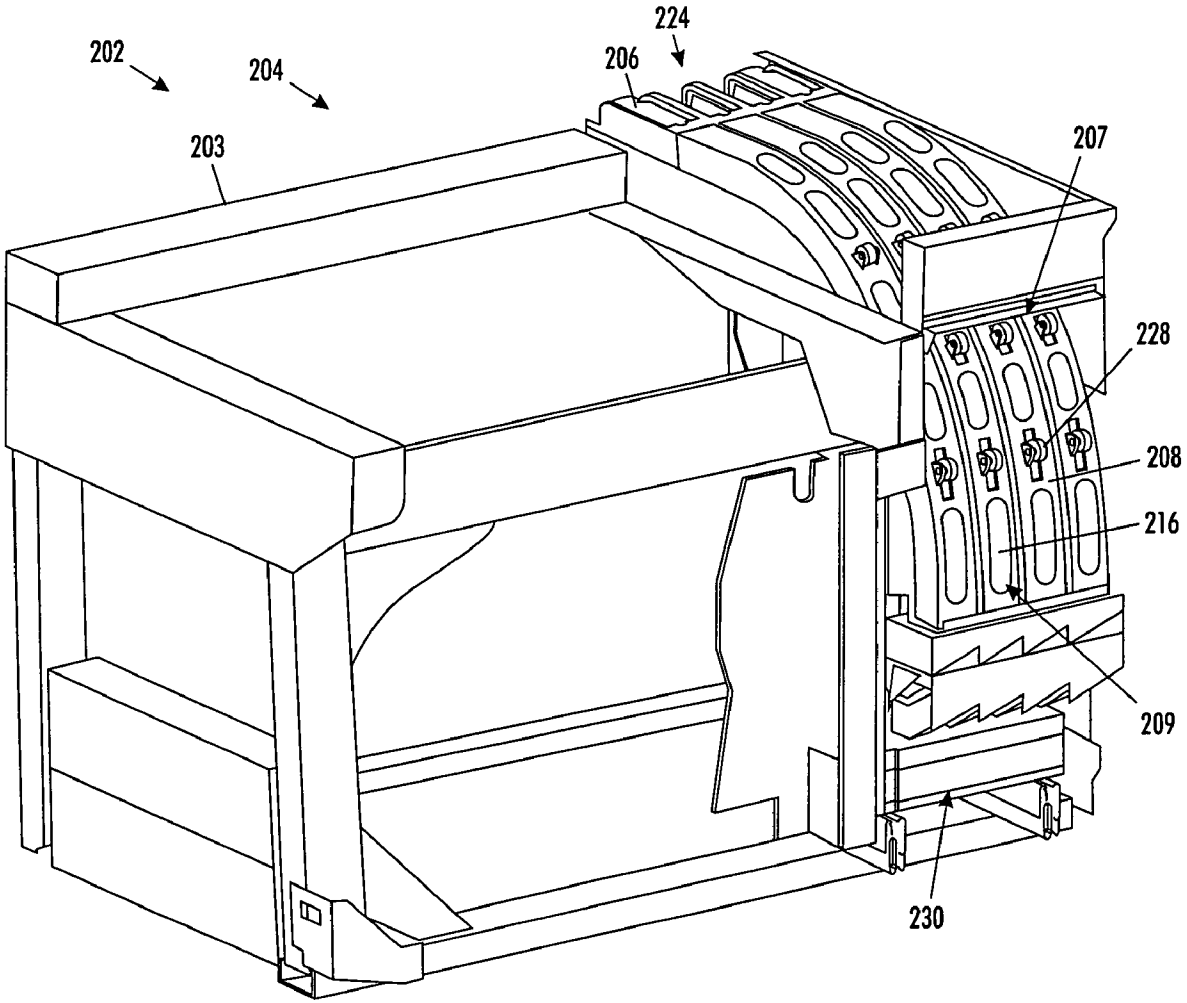
FIG. 2 is a cutaway perspective view of an embodiment of a solid ink delivery system in position in a solid ink printer for delivering solid ink sticks to printheads of the solid ink printer.

Referring now to FIG. 2, an embodiment of the solid ink printer with the solid ink delivery system is shown as printer 202. The printer 202 is a multi-color printer. The printer 202 utilizes four separate color ink sticks 206 which have respectively the colors black, cyan, magenta and yellow. The printer 202 of FIG. 2 also has a chute 208 that includes an arcuate portion 207 to increase the stick capacity of the chute 208. The arcuate portion may be comprised of a single or multiple arc axes, including continuously variable 3 dimensional arc paths, any combination of which can be of any length relative to the full arcuate portion. The term arcuate refers to these and any similar, nonlinear configuration The printer 202, as shown in FIG. 2, has a frame 203 which is used to support solid ink delivery system 204. The solid ink delivery system 204 advances the sticks 206 from loading station 224 near the top of the solid ink printer 202 to melting station 230 near the bottom of the printer 202. The printer 202 includes a plurality of chutes 208. A separate chute 208 is utilized for each of the four colors: namely cyan, magenta, black and yellow.

As shown in FIG. 2, the chutes 208 may include longitudinal openings 209 for viewing the progress of the sticks 206 within the chutes 208 and also to reduce cost and weight. Nudging members 228 may be positioned along the chute 208 for nudging the sticks 206 against belt 216.

Figure 3:
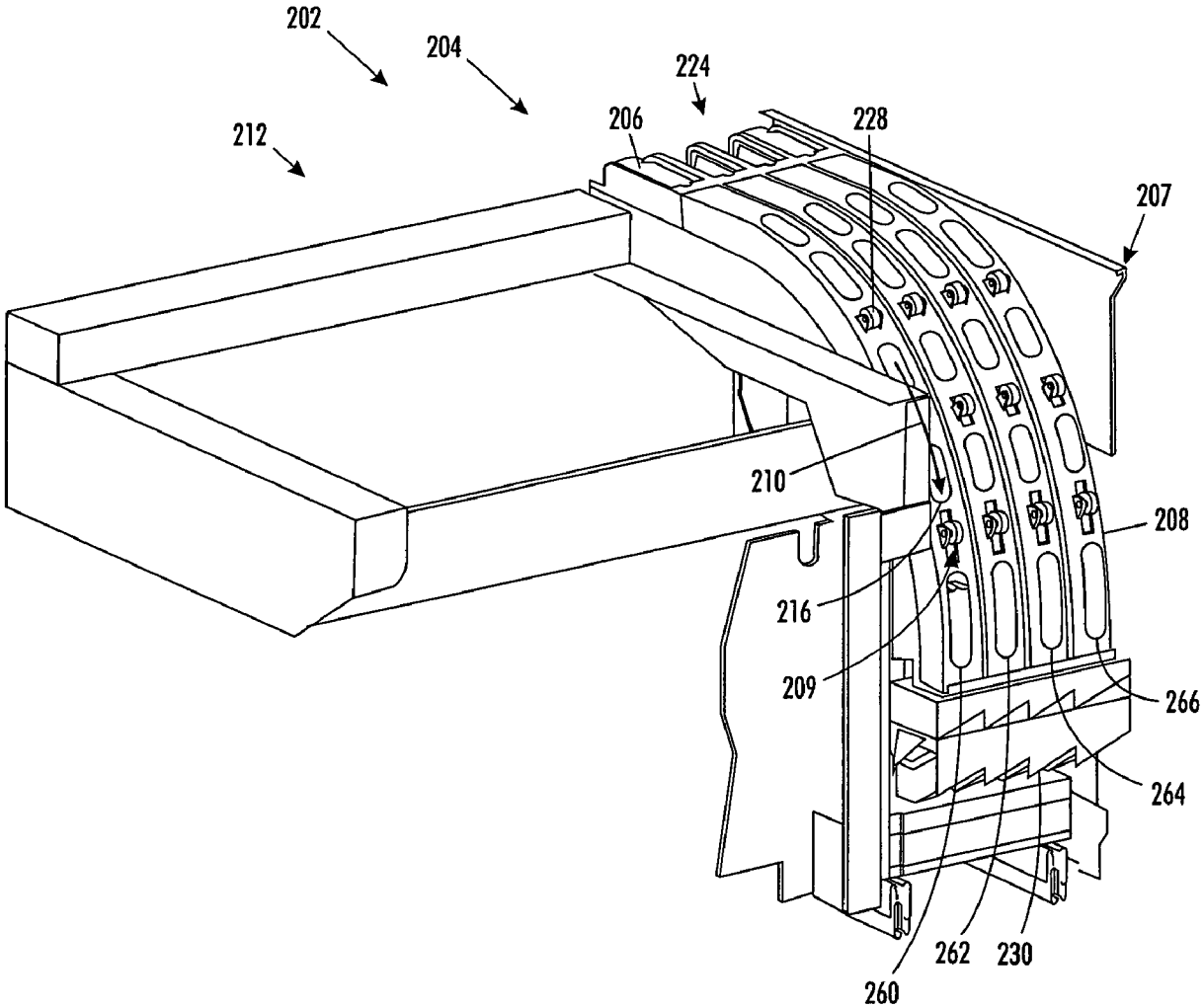
FIG. 3 is a partial cutaway perspective view of the guide for the ink sticks of the solid ink delivery system of FIG. 2 in position in a solid ink printer for delivering solid ink sticks to printheads of the printer showing the ink delivery system in greater detail.
Figure 4:
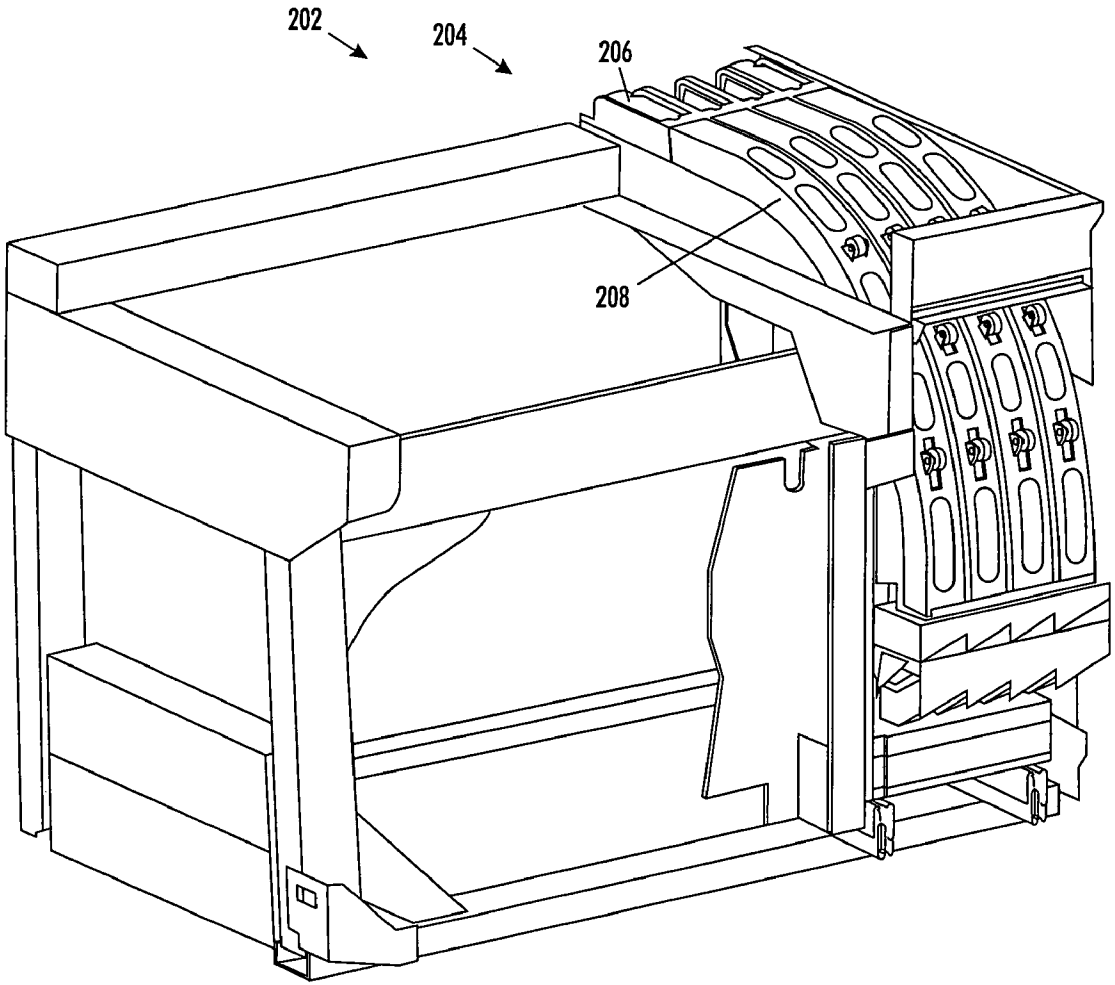
FIG. 4 is another cutaway perspective view of the solid ink delivery system of FIG. 2 in position in a solid ink printer for delivering solid ink sticks to printheads of the printer.

Referring now to FIGS. 3 & 4, the solid ink delivery system 204 of the printer 202 is shown in greater detail. The solid ink delivery system 204 includes incorporates separate solid ink delivery sub-systems, each consisting, in part, of a load or receiving section, a feed chute and a melt unit. For example, and as is shown in FIGS. 3 & 4, the solid ink delivery system 204 includes a black ink delivery sub-system 260.

The solid ink delivery system 204 further includes a second, third and fourth solid ink delivery sub-system 262, 264 and 266 providing for cyan, yellow and magenta ink sticks respectively. The colors have been described in a specific sequence but may be sequenced in any order for a particular printer. Keyed insertion openings define which color will be admitted into a sub-system color chute of the solid ink delivery system 304. Each of the solid ink delivery sub-systems 260, 262, 264 and 266 may be positioned parallel to each other and may have similar components. For simplicity, the black solid ink delivery sub-system 260 will be described in greater detail. It should be appreciated that the other sub-systems 262, 264 and 266 have similar components and operate similarly to the black solid ink delivery sub-system 260.

The black solid ink delivery sub-system 260 includes chute 208 for holding a number of ink sticks 306 and guiding them in a prescribed path 210 from loading station 224 to the melting station 230. The chute 208 may have an insertion opening with any suitable shape such that only one color of s an ink stick set may pass through the opening. The black solid ink delivery sub-system 260 further includes a drive member in the form of belt 216 which provides for engagement with a plurality of the solid ink sticks 206 and extends along a substantial portion of the prescribed path 210 of the solid ink delivery sub-system 260. In operation, the chute 208 may be loaded with several sticks. The belt 216 may simultaneously contact several sticks 206, each stick positioned at a different place in the chute 208.

Figure 5:
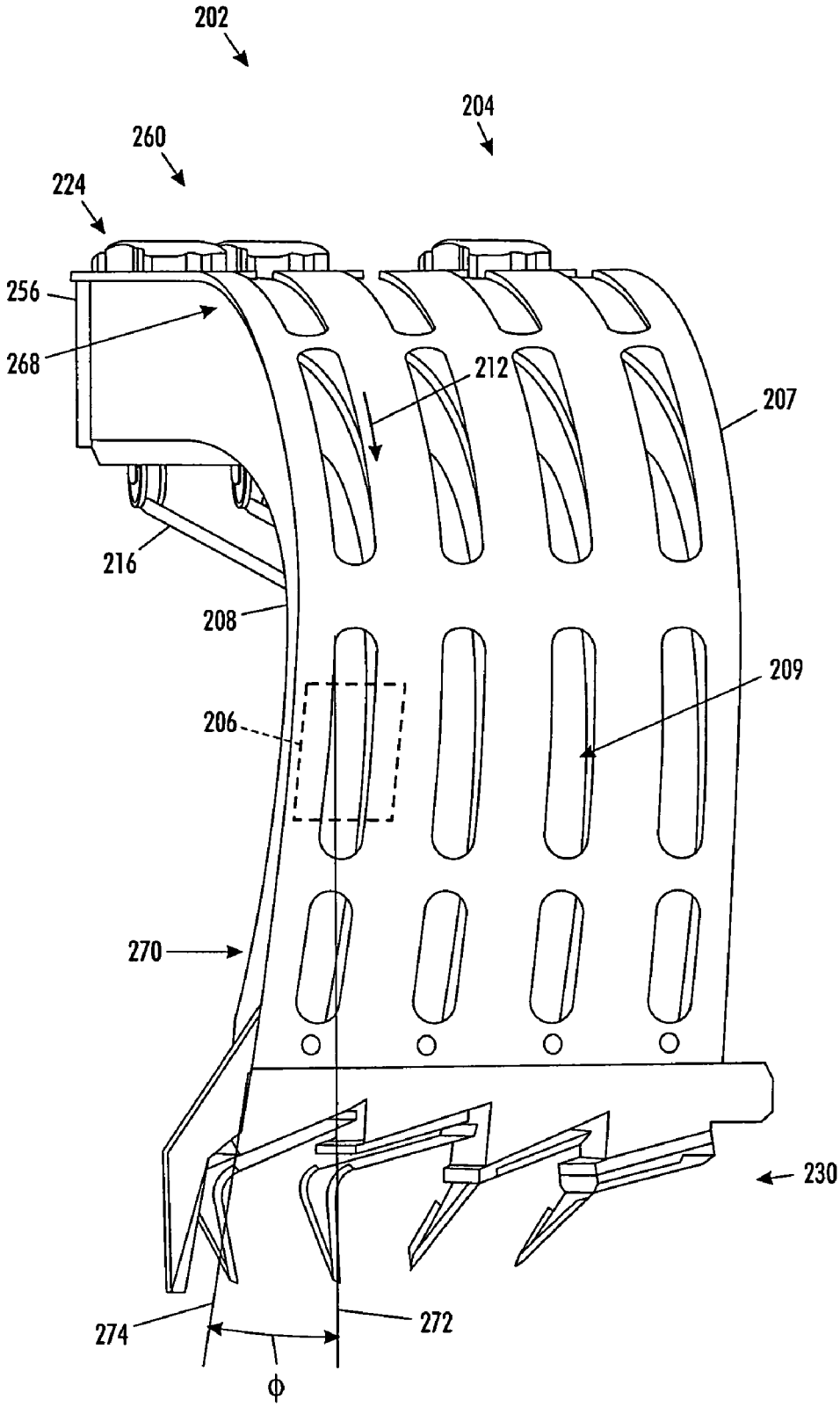
FIG. 5 is a perspective view of the guide assembly of the solid ink delivery system of FIG. 2 for advancing the ink sticks of the solid ink delivery system toward the printheads of the printer.
Figure 6:
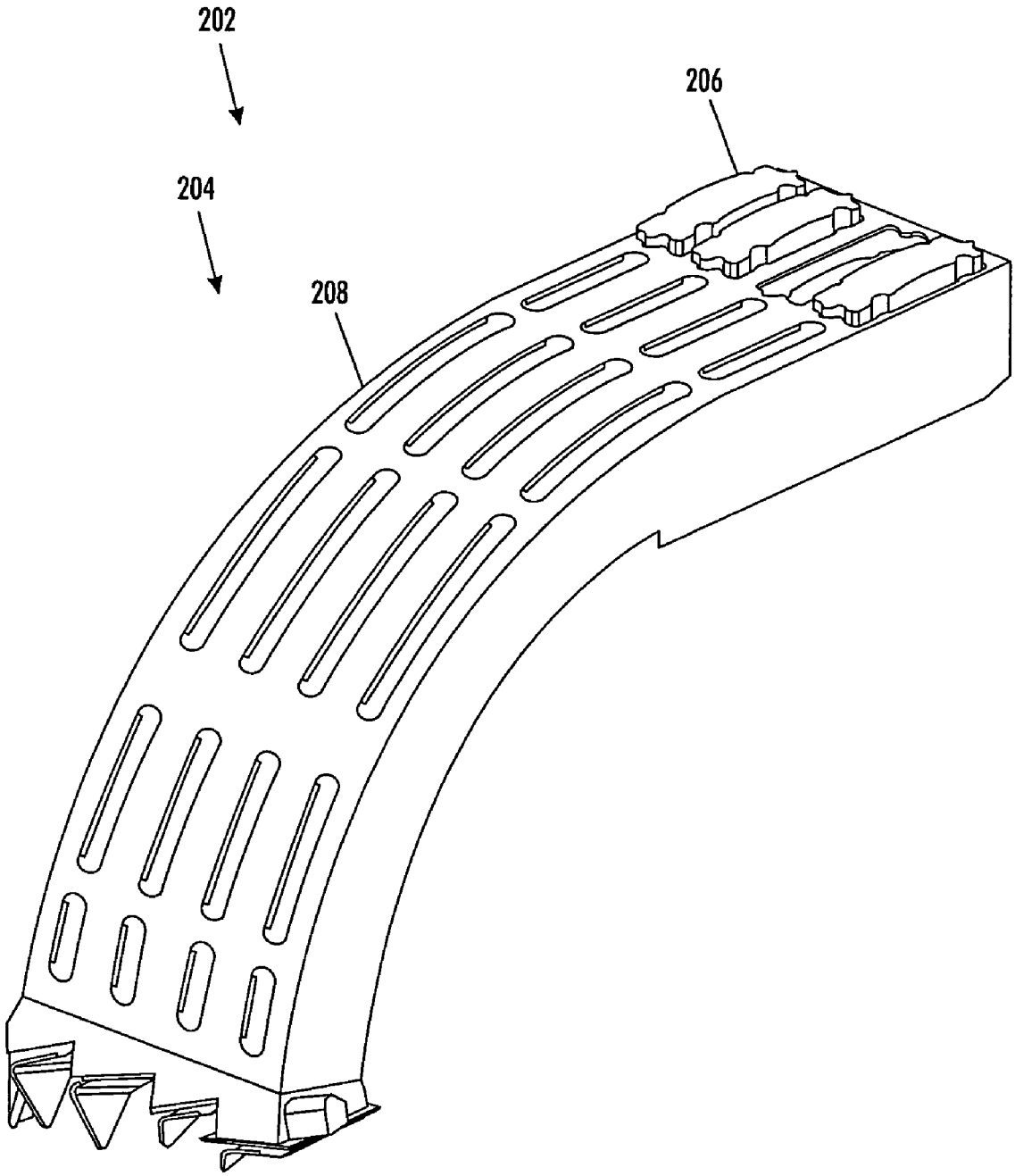
FIG. 6 is another perspective view of the guide assembly of the solid ink delivery system of FIG. 2 for advancing the ink sticks of the solid ink delivery system toward the printheads of the printer.

While the chute 208 may have any suitable shape, for example, and as shown in FIGS. 5 & 6, the chute 208 may include a first linear portion 268 adjacent the loading station 224. As shown in FIGS. 5 & 6, the first linear portion 268 may be substantially horizontal such that the solid ink stick 206 may be inserted into the end 256 of the chute 208 in a simple horizontal motion in the top of the printer 202 or the stick may be inserted vertically through a keying feature (not shown) into the chute and then advanced horizontally. An arcuate portion of the feed path may be short or may be a substantial portion of the path length. The full length of the chute may be arcuate and may consist of different or variable radii. A linear portion of the feed path may likewise be short or a substantial portion of the path length.

To better utilize the space within the printer 202, the chute 208 may have a shape that is not linear such that a greater number of solid ink sticks 206 may be placed within the printer 202 than the number possible with a linear chute. For example, and as shown in FIGS. 5 & 6, the chute 208 may include, in addition to the first linear portion 268, arcuate portion 207 extending downwardly from the first linear portion 268 of the chute 208. The chute 208 may further include a second linear portion 270 extending downwardly from the arcuate portion 207 of the chute 208. The second linear portion 270 may be substantially vertical and be positioned over the melting station 230 such that the solid ink sticks 206 may be delivered to the melting station 230 by gravity.

The chute may lay within a single plane, for example, plane 272. Alternatively, and as shown in FIGS. 5 & 6, the chute 208 may extend through a series of non-parallel planes. For example, and as shown in FIG. 5, the chute 208 may move downwardly and outwardly to an angled plane 274 which is skewed with respect to the vertical plane 272. The planes 272 and 274 form an angle $\phi$ there between. The angle $\phi$ may be any angle capable of providing for a larger number of solid ink sticks 206 in chute 208.

Figure 7:
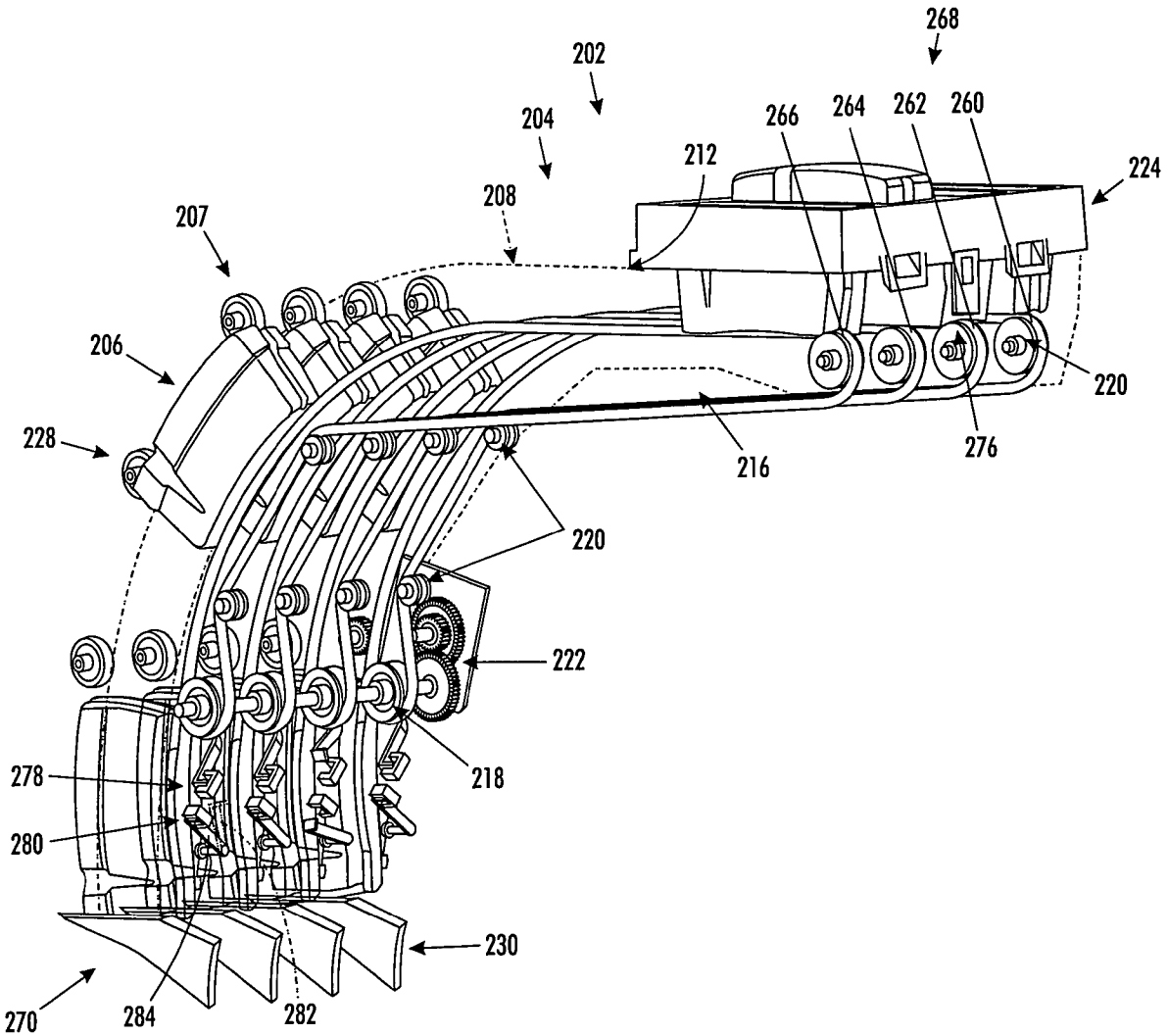
FIG. 7 is another perspective view of the guide assembly of the solid ink delivery system of FIG. 2 including the drive member for advancing the ink sticks of the solid ink delivery system toward the printheads of the printer.

Referring now to FIG. 7, the drive belt 216 of the solid ink delivery system 204 of the printer 202 is shown in greater detail. The drive belt 216 may require that a portion of the belt 216 have a shape to conform to the chute 208. The conforming shape may be in the arcuate portion 207 of the chute 208, as well as in the first linear portion 268 and the second linear portion 270 of the chute 208. The belt 216 may be driven, for example, by a motor transmission assembly 222 which is used to rotate drive pulley 218.

The drive belt 216 may, for example, have a circular cross section and be a continuous belt extending from the drive pulley 218 through a series of inlet idler pulleys 220 and chute 208. Nudging members 228 in the form of, for example, pinch rollers may be spring loaded and biased toward the belt 216 to assure sufficient friction between the belt 216 and the solid ink sticks 206 such that the solid ink sticks do not fall by gravity and slip away from the belt 216.

The solid ink delivery system 204 of the printer 202 may further include a series of sensors for determining the presence or absence of the solid ink sticks 206 within different portions of the chute 208. An inlet sensor assembly 276 may be used to indicate additional ink sticks 206 may be added to the chute 208. The inlet sensor assembly 276 may be positioned near loading station 224. A low sensor assembly 278 may be used to indicate a low quantity of ink sticks 206 in the chute 208. The low sensor assembly 278 may be positioned spaced from the melt station 230.

An out sensor assembly 280 may be used to indicate the absence of ink sticks 206 in the chute 208. The out sensor assembly 280 may be positioned adjacent to the melt station 230. The sensor assemblies 276, 278 and 280 may have any suitable shape and may, for example, and as is shown in FIG. 6, be in the form of pivoting flags or sensors that pivot about a wall of the chute 208 and transition a switch, such as a micro switch or an optical interrupter. The presence of a stick 206 causes the sensors to move from first position 282, as shown in phantom, to second position 284, as shown in solid. A sensor or switch may be used to determine whether the sensors 276, 278 or 280 are in the first position 282 or in the second position 284. Other sensing devices may be used in conjunction with or in place of a mechanical flag system, such as a proximity switch or reflective or retro-reflective optical sensor.

Figure 7A:
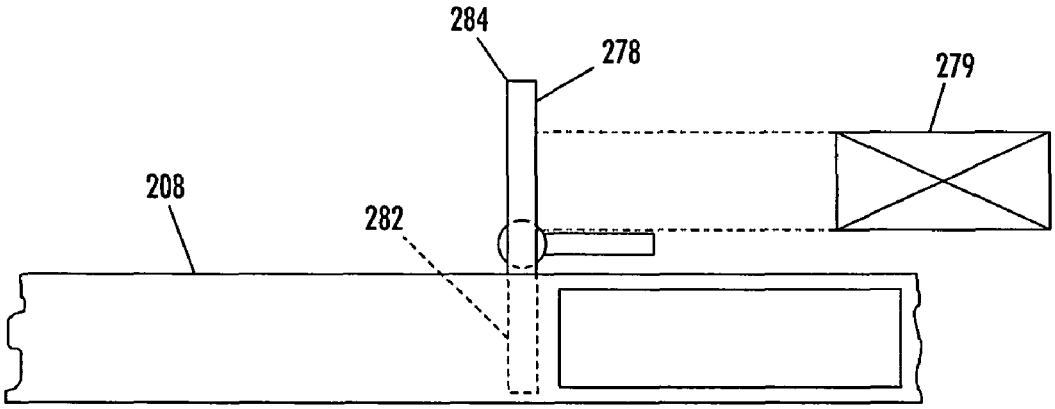
FIG. 7A is a partial plan view of a sensor in position in the guide assembly of FIG. 7.

Referring now to FIG. 7A, sensor 278 is shown in position in wall of the chute 208. The sensor 278 pivots about a wall of the chute 208. The presence of a stick 206 causes the sensor 278 to move from first position 282, as shown in phantom, to second position 284, as shown in solid. A sensor or switch 279 may be used to determine whether the sensor 278 is in the first position 282 or in the second position 284.

Figure 8:
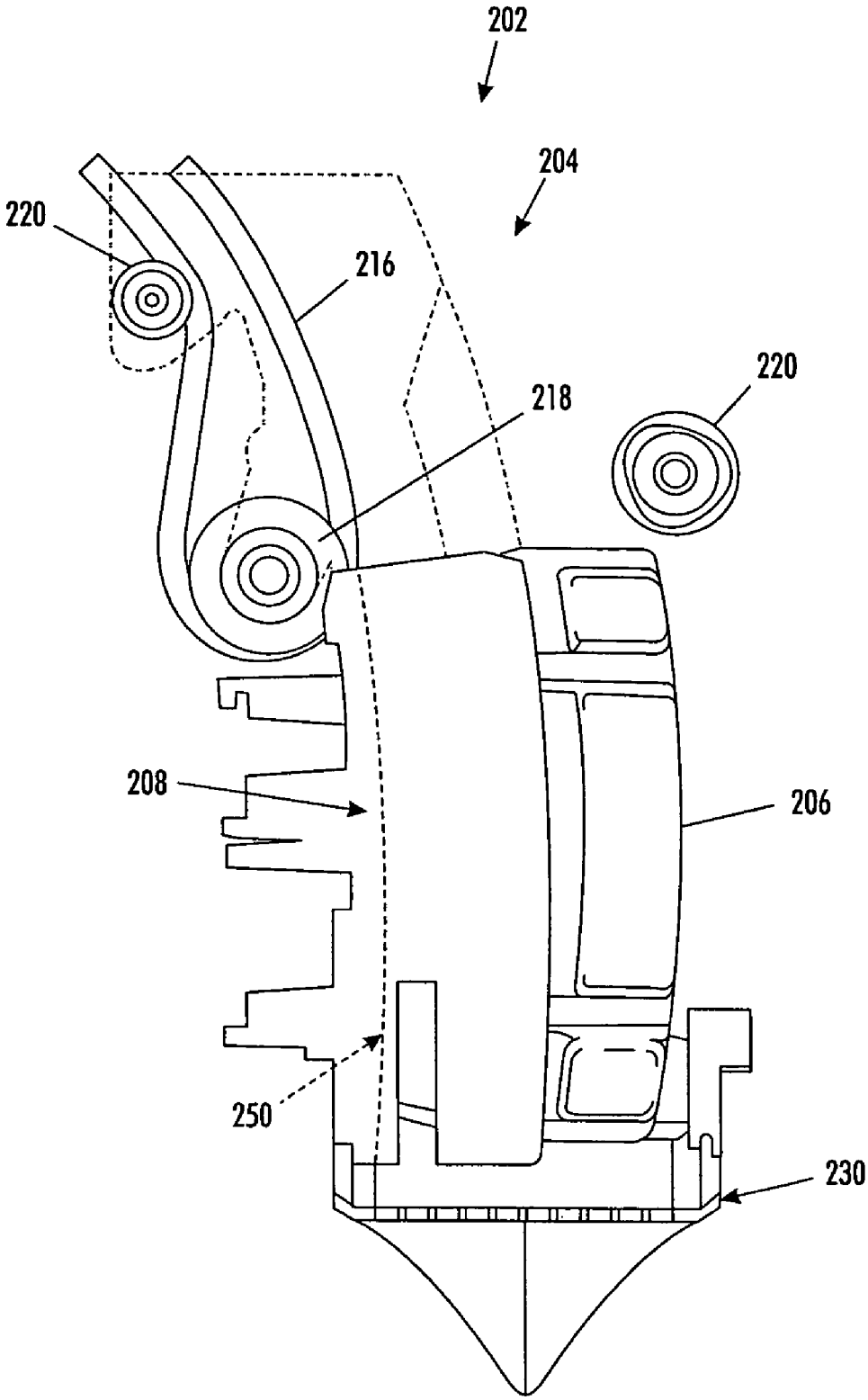
FIG. 8 is partial perspective view of the guide assembly including the drive member for advancing the ink sticks of the solid ink delivery system of FIG. 2 showing the portion adjacent the print heads in greater detail.

Referring now to FIG. 8, the solid ink delivery system 204 of the printer 202 is shown in the location around the melt station 230. As shown in FIG. 8, the drive pulley 218 and the belt 216 are positioned somewhat away from the solid ink stick 206 when the solid ink stick 206 is in the melt station 230. The spacing of the belt 216 away from the solid ink stick 206, when the solid ink stick 206 is in the melt station 230, may permit gravity to be the only factor causing the solid ink sticks 206 to be forced against a melt unit when the belt is stopped. If the belt 216 continues to run, however, additional sticks 206, if present, may contact the belt 216 and push against the lower stick 206, urging it toward the melt station 230.

It should be appreciated that, alternatively, the pulley 218 may be positioned low enough that the solid ink stick 206 may be in contact with the pulley 218 when the stick 206 is in the melt station 230. With such a configuration, the belt 216 may insure sufficient forces are exerted on the solid ink stick 206 to increase the contact pressure of the solid ink stick 206 against the melt unit.

Figure 9:
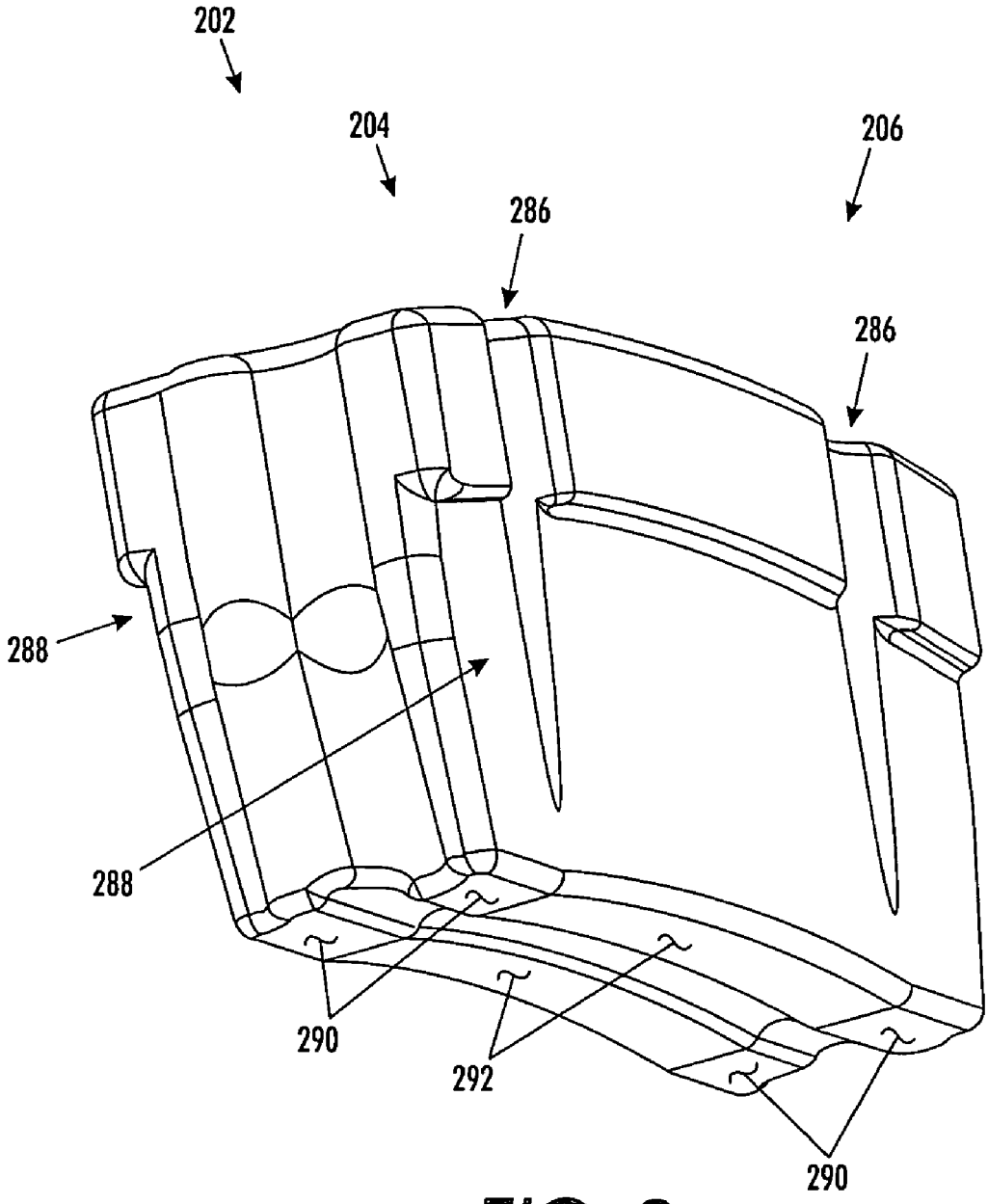
FIG. 9 is a perspective view of a solid ink stick for use with the guide assembly for advancing the ink sticks of the solid ink delivery system of FIG. 2 toward the print heads of the printer.

Referring now to FIG. 9, solid ink stick 206 for use with the printer 202 of FIGS. 2-8 is shown in greater detail. The solid ink stick 206 as shown in FIG. 9 includes a series of vertical keying features used, among other things, to differentiate sticks of different colors and different printer models. The stick keying features are used to admit or block insertion of the ink through the keyed insertion opening of the solid ink delivery system 304. The solid ink stick 206 further includes a series of horizontal shaped features 288 for guiding, supporting or limiting feed of the ink stick 206 along the chute feedpath. It should be appreciated that that keying and shaped features can be configured to accomplish the same functions with a horizontal or other alternate loading orientation.

The solid ink stick 206, as shown in FIG. 9, includes two spaced-apart pairs of spaced-apart flat portions 290, one pair on each end of the stick 206, for accommodating the linear portions of the feed path, as well as a centrally located pair of spaced apart arcuate portions 292, to accommodate the curved or arcuate portion of ink feed path. The ink stick groove 250 likewise has linear and arcuate portions.

Figure 10:
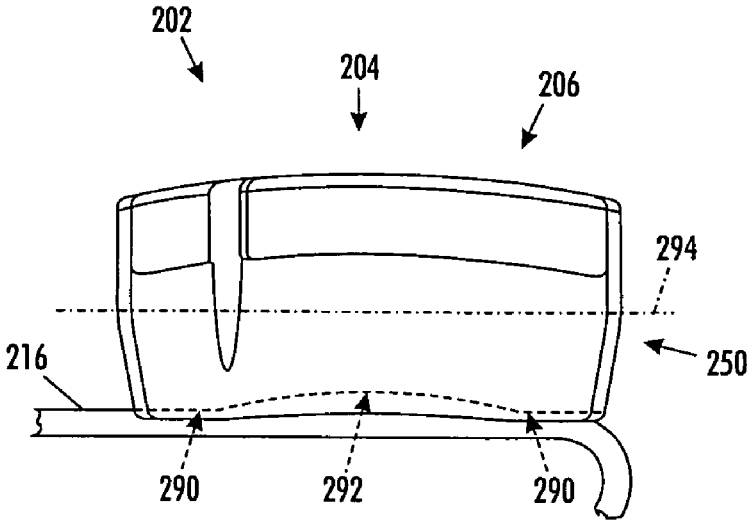
FIG. 10 is a plan view of the solid ink stick of FIG. 9 in position on a flat portion of the drive member of FIG. 7.

Referring now to FIG. 10, the solid ink stick 206 is shown in position on a linear portion of the belt 216 of the solid ink delivery system 204 of the printer 202. The solid ink stick 206 contacts the belt 216 at the end portions 290 of the solid ink stick 206 and the groove 250 formed in the solid ink stick 206 cooperates with the belt 216 to advance the stick 206. As shown in FIG. 10, the solid ink stick 206 is arcuate or curved along longitudinal axis 294.

Figure 11:
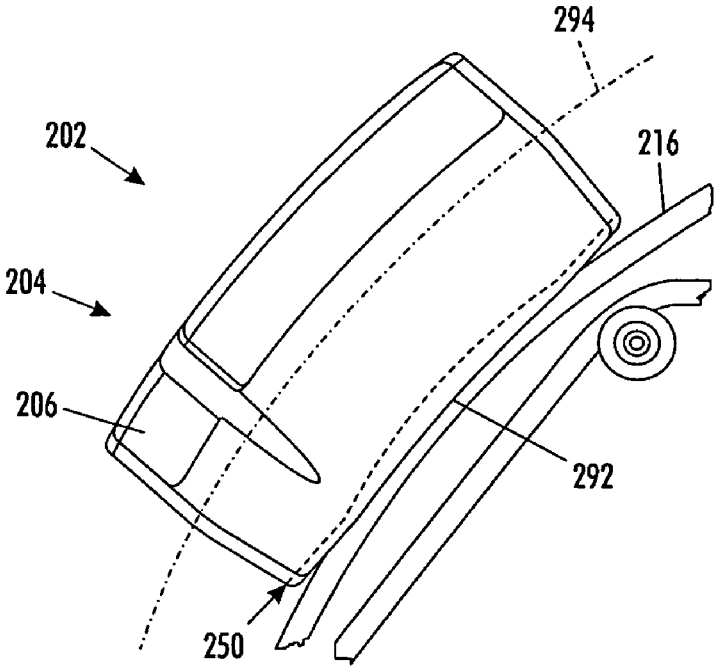
FIG. 11 is an plan view of the solid ink stick of FIG. 9 in position on a curved portion of the drive member of the delivery system of FIG. 7.

Referring to FIG. 11, the solid ink stick 206 is shown in position along an arcuate portion of the belt 216. As shown in FIG. 11, the central arcuate portion 292 of the solid ink stick 206 engages with the belt 216.

Figure 12:
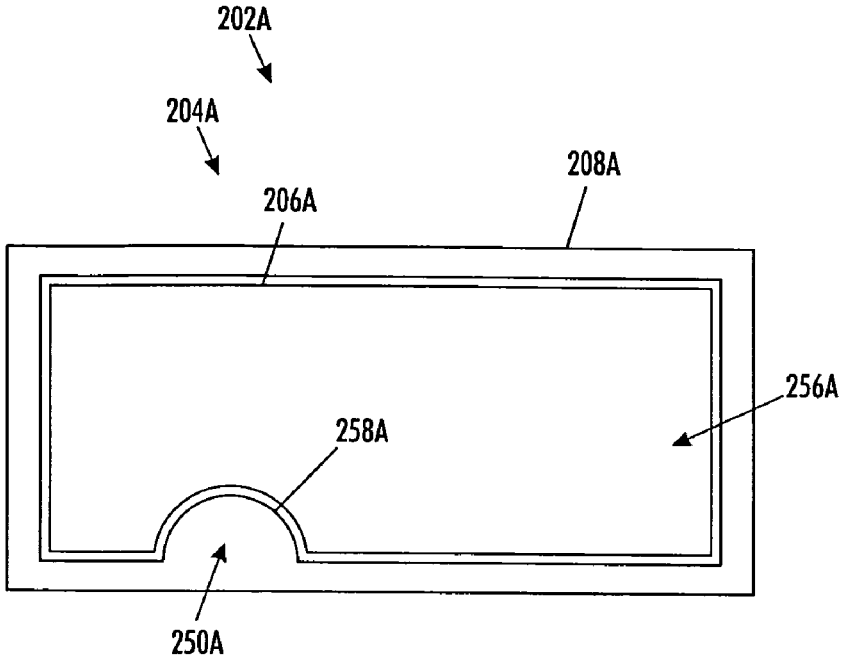
FIG. 12 is a cross sectional view of a drive member and chute of a solid ink delivery system for use in a printing machine with the drive member being not centrally positioned with respect to the chute and the ink stick according to another embodiment.

Referring now to FIG. 12, yet another embodiment is shown as solid ink printer 202A which utilizes a solid ink delivery system 204A. The solid ink delivery system 204A is similar to the solid ink system 204 of FIGS. 7-14 except that the solid ink delivery system 204A includes a solid ink stick 206A which has a stick belt guide 250A which is not central within the stick 206A. The end 256A of the guide 208A includes a key 258A which likewise is not central such that the stick 206A matches the key 258A.

Figure 13:
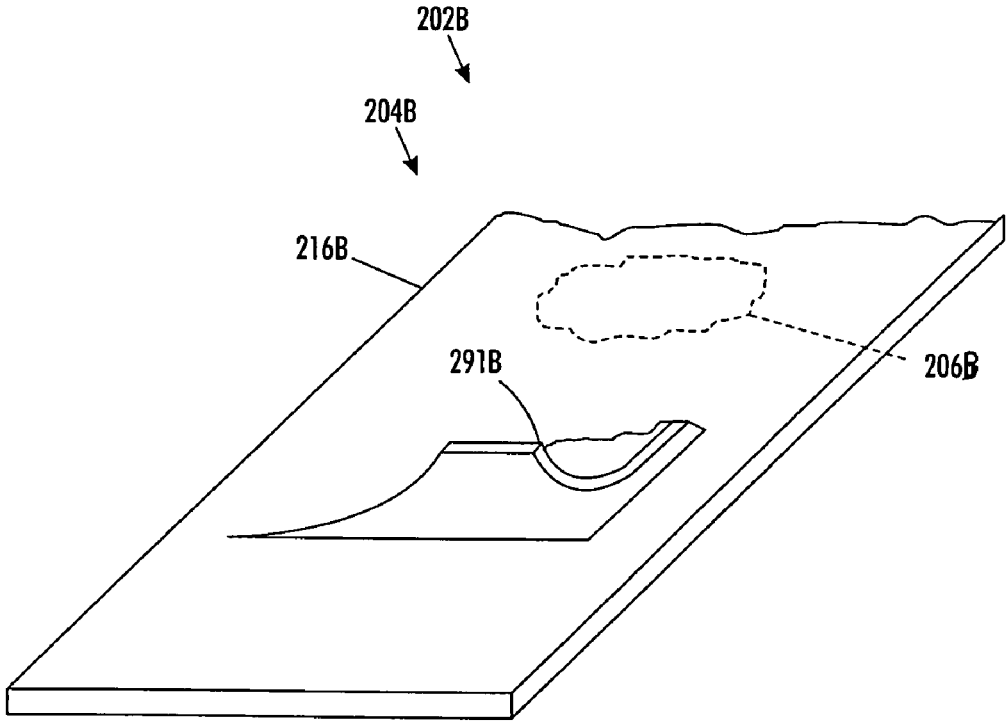
FIG. 13 is a perspective view of a flat drive member with a cog for use in a solid ink delivery system of a printing machine according to another embodiment.

Referring now to FIG. 13, yet another embodiment is shown as solid ink printer 202B which includes a solid ink delivery system 204B which includes a belt 216B which has a rectangular cross section or is flat. It should be appreciated that the belt 216B may include cogs 291B which are formed on a surface of the belt 216B for contact with the sticks 206B.

Figure 14:
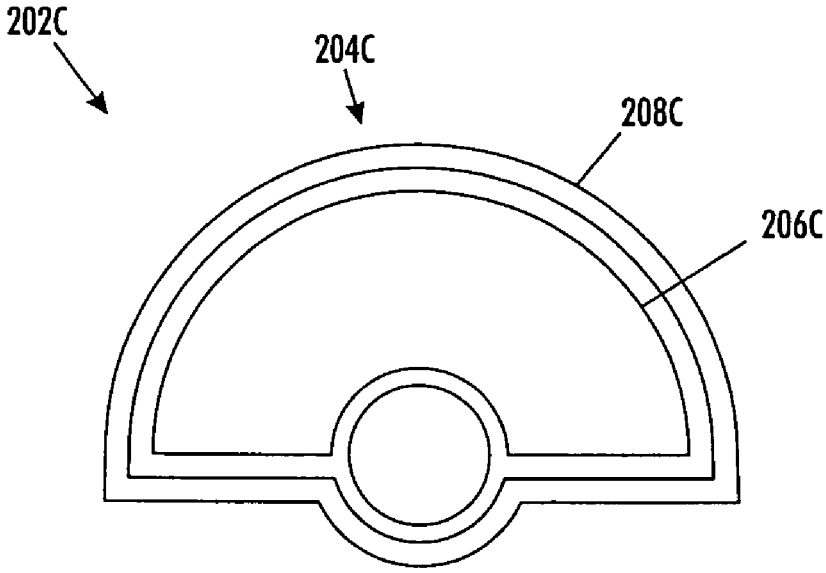
FIG. 14 is a cross sectional view of a D-shaped chute with a drive member of a solid ink delivery system for use in a printing machine according to another embodiment.

Referring now to FIG. 14, yet another embodiment, is shown as solid ink printer 202C which includes solid ink delivery system 204C which is different than the solid ink delivery system 204 of FIGS. 2-8 in that the solid ink delivery system 204C includes a chute 208C which is semi-circular and has a stick 206C which mates with the chute 208C.

Figure 15:
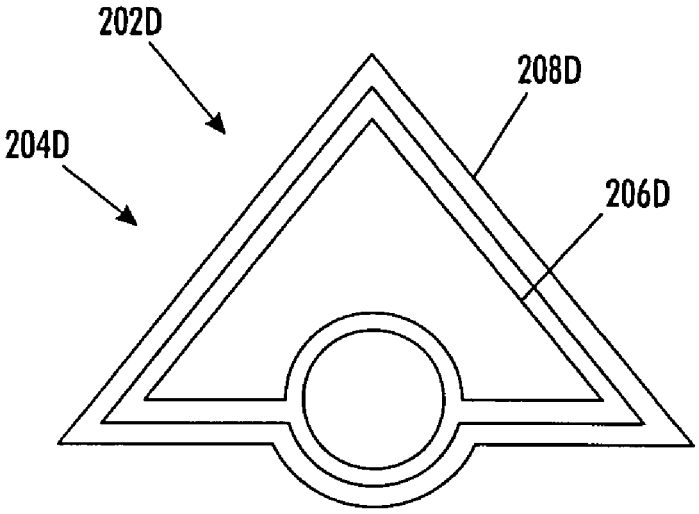
FIG. 15 is a cross sectional view of a triangular-shaped chute with a drive member of a solid ink delivery system for use in a printing machine according to another embodiment.

Referring now to FIG. 15, another embodiment is shown as solid ink printer 202D which includes a solid ink delivery system 204D which is different than the solid ink delivery system 204 of FIGS. 7-14 in that solid ink delivery system 204D includes a chute 208D which is triangular. The triangular chute 208D receives a triangular solid ink stick 206D.

Figure 16:
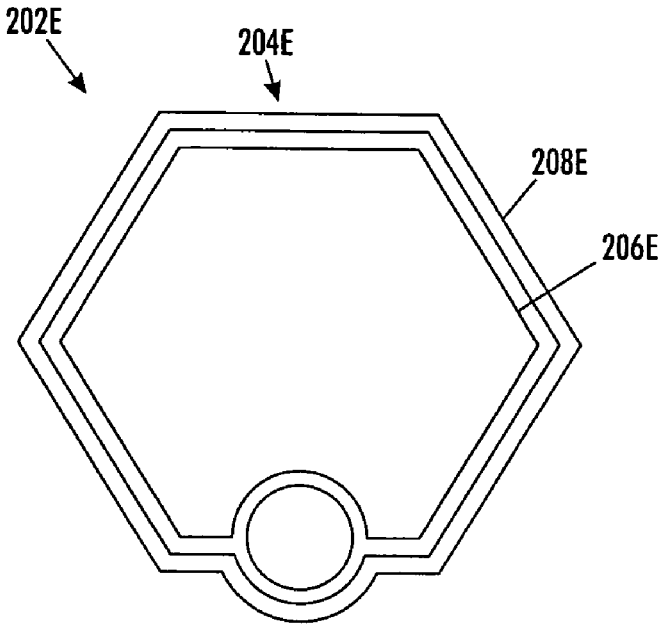
FIG. 16 is a cross sectional view of a hexagonal-shaped chute with a drive member of a solid ink delivery system for use in a printing machine according to another embodiment.

Referring now to FIG. 16, yet another embodiment is shown as solid ink printer 202E which includes a solid ink delivery system 204E which is different than the solid ink delivery system of 204 of FIGS. 2-8 in that the solid ink delivery system 204E includes a chute 208E which is hexagonal and cooperates with a hexagonal solid ink stick 206E.

Figure 17:
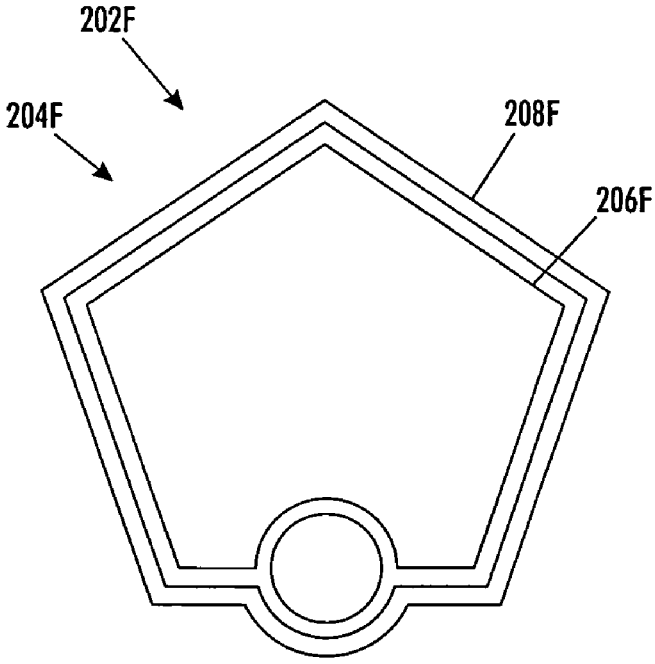
FIG. 17 is a cross sectional view of a pentagonal-shaped chute with a drive member of a solid ink delivery system for use in a printing machine according to another embodiment.

Referring now to FIG. 17, yet another embodiment is shown as solid ink printer 202F which includes a solid ink delivery system 204F which is different than the solid ink delivery system 204 of FIGS. 2-8 in that the solid ink delivery system 204F includes a chute 208F which is pentagonal and cooperates with a stick 206F which is also pentagonal.

The chute configuration examples shown in the various alternative embodiments are depicted as fully matching the ink shape at least in one sectional axis. The chute need not match the ink shape in this fashion and need not be completely encircling. One or more sides may be fully or partially open or differently shaped. The side surfaces of the chute do not need to be continuous over the chute length. The chute need only provide an appropriate level of support and/or guidance to complement reliable loading and feeding of ink sticks intended for use in any configuration.

Figure 18:
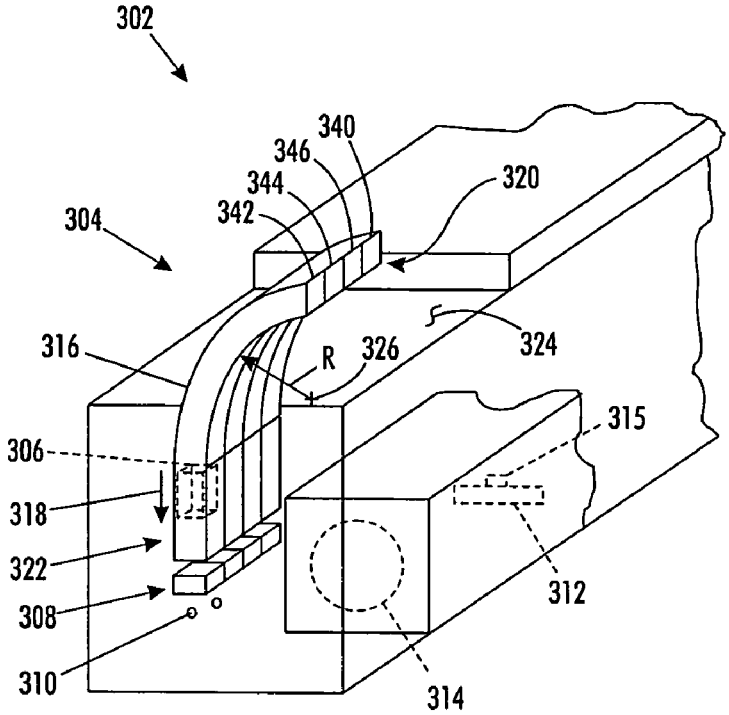
FIG. 18 is a partial perspective view of another embodiment solid ink delivery system for delivering solid ink stock to a melting station for converting the solid ink into liquid form for delivery to print heads of the printer.

Referring now to FIG. 18, a solid ink printer 302 is shown. The printer 302 includes a solid ink delivery system 304 for use with a solid ink stick 306. The printer 302 includes the solid ink delivery system 304 for delivering the solid ink stick 306 to a melting station where a melting unit 308 is used to melt the solid ink stick 306. The ink in the solid ink stick 306 is transferred from a solid to a liquid and the liquid ink 310 is transferred to media, for example, a sheet of paper 312, by a drum 314 to form an image 315 on the paper 312. The solid ink delivery system 304 includes a guide 316 for guiding the solid ink stick 306 in a prescribed path 318. The guide 316 may be, for example, in the form of a chute. The guide 316 defines a loading position 320 to permit the solid ink stick 306 to be placed into the guide or chute 316.

The chute 316 also defines a delivery position 322 adjacent to the melting unit 308. The loading position 320 is located above the delivery position 322. The solid ink stick 306 is slideably fitted to the chute 316 where by only gravity advances the solid ink stick 306 from the loading position 320 to the delivery position 322.

It should be appreciated that the chute 316 may have any suitable shape such that the sticks 306 fall by gravity from loading position 320, that may be positioned near, for example, printer top work surface 324, toward the melting unit 308. The chute 316 may include linear and arcuate portions or may, as is shown in FIG. 18, be of a continuous arcuate shape defined by a radius R extending from the origin 326. It should be appreciated that origin 326 may be positioned anywhere with respect to the chute 316 and that the radius R may be constant, or, as is shown in FIG. 18, vary such that the radius R may increase such that the chute is virtually vertical near the melting unit 308.

Figure 19:
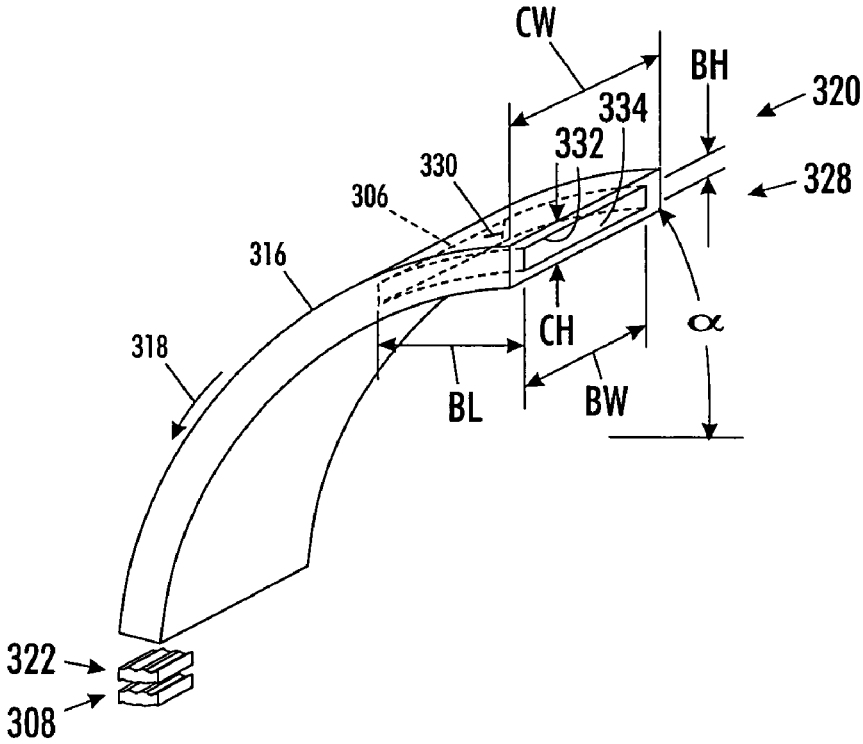
FIG. 19 is a partial perspective view of the chute of the solid ink delivery system of FIG. 18.

Referring now to FIG. 19, it should be appreciated that the chute 316 forms a stick opening 328 in a suitable size and shape and to provide for the uniform movement of the sticks 306 down the chute 316 along the path 318. To avoid cross loading or jamming of the sticks 306 in the chute 316, the sticks 306 may have an external periphery 330 which closely conforms with internal periphery 332 formed in the stick opening 328 of the chute 316.

For example, and as is shown in FIG. 19, the sticks 306 may be rectangular and the stick opening 328 of the chute 316 may be rectangular and slightly larger than the sticks 306 to provide the ability of the sticks 306 to fall by gravity down the chute 316. For example, and as shown in FIG. 19, the sticks have a stick length BL, a stick height BH, and a stick width BW. The stick opening 328 of the chute 316 may be defined by a chute height CH slightly larger than the stick height BH and a chute width CW slightly wider than the stick width BW.

Further to assure that the sticks 306 fall by gravity down the opening 328 of the chute 316 and as is shown in FIG. 19, the bottom surface 334 of the chute opening 328 may form an angle $\alpha$ with the horizontal plane such that the force of gravity may exceed the coefficient of friction between the sticks 306 and the chute lower surface 334 such that the sticks advance along the path 318 from the loading position 320 to the delivery position 322. A non-stick surface may be applied to the bottom surface 334, such as Teflon®, a trademark of E. I. DuPont de Nemours and Company.

Figure 20:
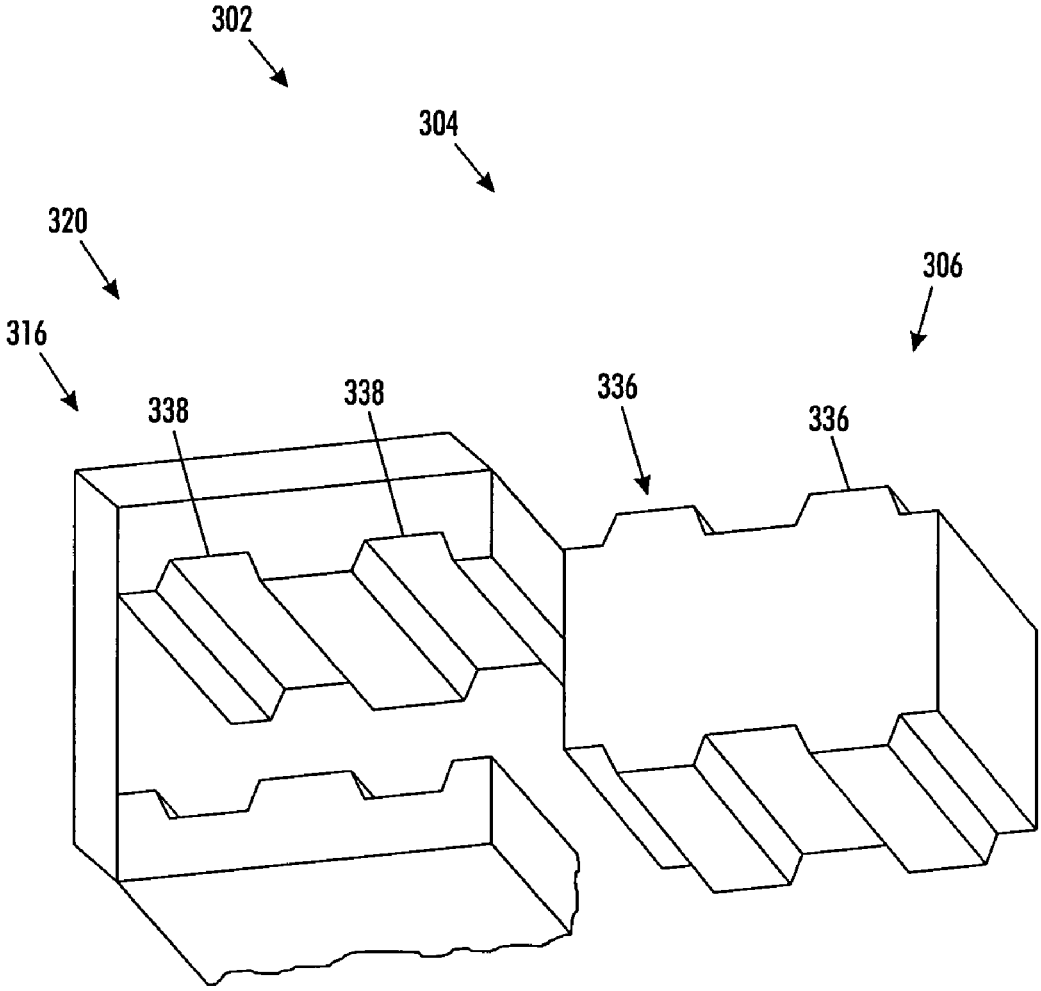
FIG. 20 is a partial perspective view of an ink stick and the loading station of the chute of FIG. 3.

Referring now to FIG. 20, the stick 306 and the chute 316 of the solid ink delivery system 304 of the printer 302 is shown in greater detail near the loading position 320 of the solid ink delivery system 304. To assure the proper solid ink stick 306 is placed in the chute 316, the stick 306 and the chute 316 may have matched keying systems in the form of, for example, bosses 336 located on the stick 306 that mate with recesses 338 formed in the chute 316. The bosses 336 and recesses 338 serve to assure that only the proper solid ink stick is feed into the chute 316. This is particularly important in color machines where the improper color of ink stick should not be loaded into the wrong chute.

Referring again to FIG. 18, the printer 302, as shown in FIG. 3, is a color ink printer. The chute 316, as shown in FIG. 18, include a first black chute 340, a second cyan ink chute 342, a third magenta ink chute 344, and a fourth yellow ink chute 346. The four ink chutes 340, 342, 344 and 346 may each have their respective keys to provide for the entry of only the proper ink stick. It should be appreciated that the printer disclosed herein may be a black or mono-chrome printer having a solitary chute with gravity feed.

Figure 21:
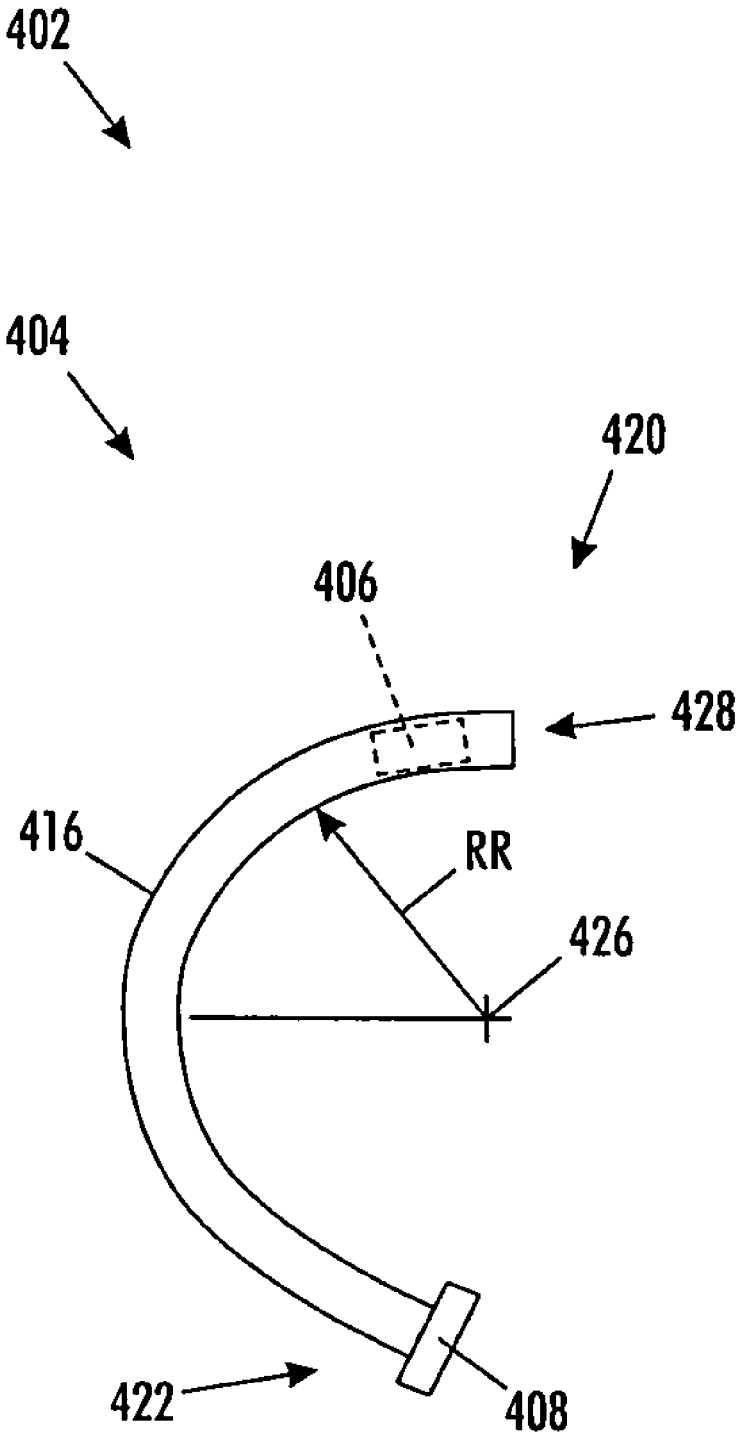
FIG. 21 is a partial plan view of another embodiment of the solid ink delivery system with a chute that has a portion that extends underneath another portion of the chute.

Referring now to FIG. 21, another embodiment is shown as ink printer 402 which includes solid ink delivery ink system 404 that is somewhat different than the solid ink delivery system 304 of the ink printer 302 of FIGS. 18-20. The solid ink delivery system 404 of FIG. 21 includes a chute 416 which is different than the chute 316 of the solid ink delivery system 304 of FIGS. 18-20. The chute 416 is similarly an arcuate chute and is defined by radius RR extending from origin 426. The radius RR may be constant or may vary, for example, increase.

The chute 416, as shown in FIG. 21, has a path that crosses over itself, or in other words the upper portions of the chute 416 may be positioned over the lower portions of chute 416. Such a chute configuration such as chute 416 may be conservative of space. It should be appreciated that the chute 416 may lie in a single plane or in a plurality of non-parallel planes. In other words, the chute 416 may form, for example, a spiral shape or a helical shape.

The chute 416 may have any size and shape and opening 428 of the chute 416 may, for example, be rectangular, triangular, pentagonal, or have any other shape. The size and shape of the opening 428 of the chute 416 is preferably similar to the size and shape of the solid ink stick 406 to be positioned in the chute 416 so that the stick 406 may freely fall by gravity down the chute 416 from the loading position 420 to delivery position 422 adjacent melting units 408.

Figure 22:
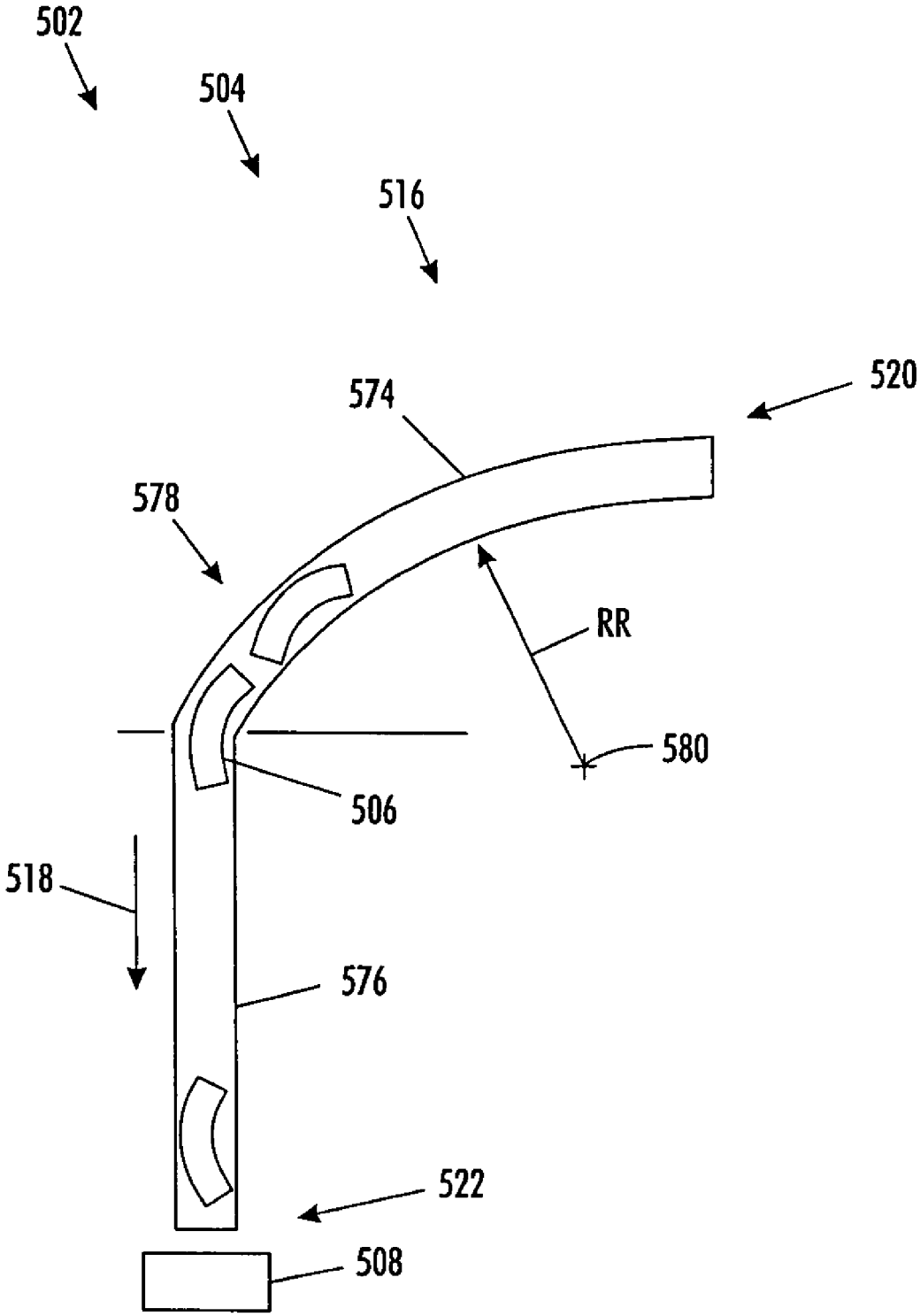
FIG. 22 is a plan view of a further embodiment of the solid ink delivery system in the form of a solid ink delivery system with a chute having a linear portion and a curved portion.

Referring now to FIG. 22, yet another embodiment is shown as solid ink printer 502. The printer 502 includes a solid ink delivery system 504 that has a chute 516 that includes an arcuate upper portion 574 and a linear lower portion 576. The arcuate upper portion 574 may extend from the loading position 520 to the transition position 578 located between the arcuate upper portion 574 and the linear lower portion 576 of the chute 516. The arcuate upper portion 574 may be defined by radius RR extending from origin 580. The linear lower portion 576 extends from the transition position 578 to delivery position 522 adjacent melting unit 508. The linear lower portion 576, as shown in FIG. 22, may be vertical. It should be appreciated that the linear portion 576 may, alternatively, be angled.

The solid ink stick 506 for use in the printer 502 may be rectangular or may, as is shown in FIG. 22, be arcuate. The arcuate shape of the solid ink stick 506 permits the motion of the stick 506 through the arcuate upper portion 574 and the transition position 578 of the chute 516.

Figure 23:
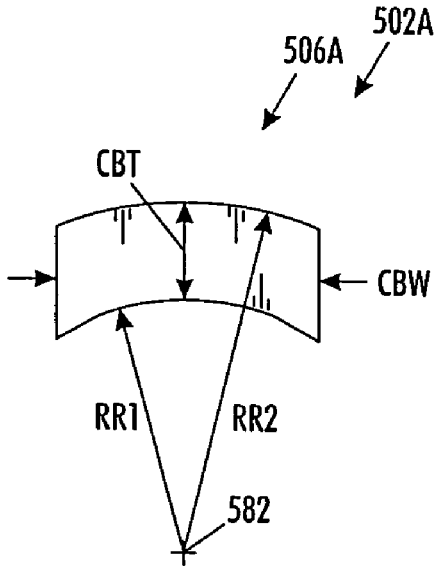
FIG. 23 is a plan view of the ink stick for use in the chute of the solid ink delivery system of FIG. 22.

Referring now to FIG. 23, the solid ink stick 506 of the printer 502 is shown in greater detail. The solid ink stick 506 has a width CBW and a thickness CBT. The thickness CBT is defined by radius RR1 and RR2 extending from origin 582. Radii RR1 and RR2 may be optimized depending on the shape of the arcuate upper portion 574 and the linear lower portion 576 of the chute 516 of the delivery system 504 of the printer 502.

Figure 24:
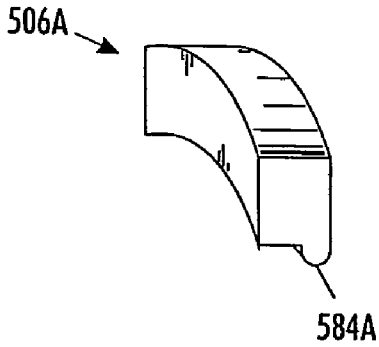
FIG. 24 is a perspective view of another ink stick with a guidance feature for use with a further embodiment of the solid ink delivery system.

Referring now to FIG. 24, an alternate solid ink stick 506A is shown for use in the printer 502. It should be appreciated that the solid stick 506A includes a guidance feature 584A that conforms to a mating groove in the chute (not shown).

Figure 25:
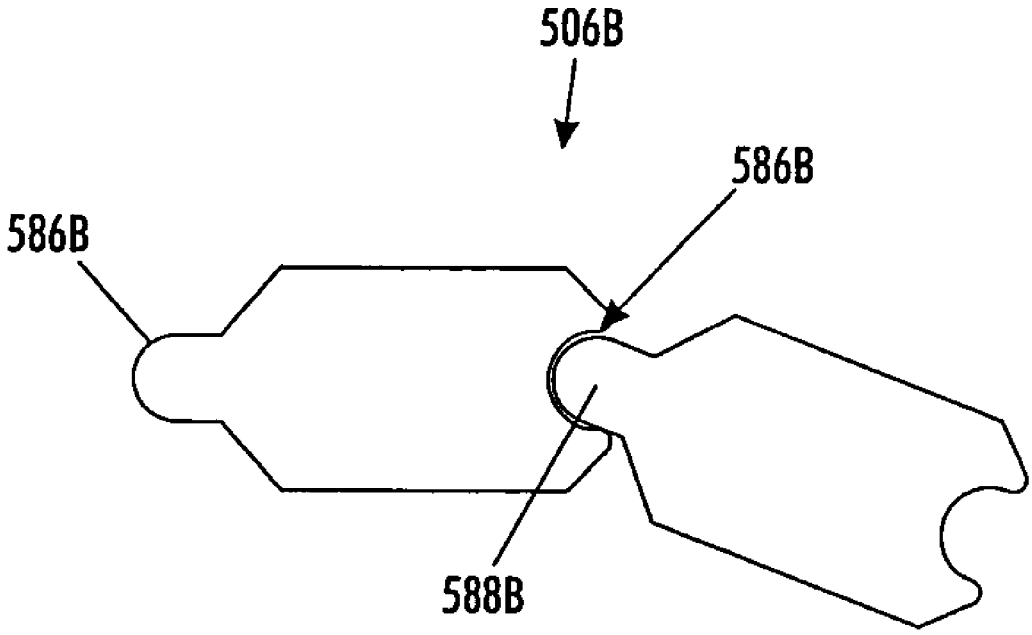
FIG. 25 is a plan view of another solid ink stick with guidance feature for use with the chute for the solid ink delivery system of FIG. 14.

Referring now to FIG. 25, a solid ink stick 506B is shown for use in prescribed path 518 of the chute 516 of FIG. 22. The stick 506B includes a protrusion 586B at one end which mates with a groove 588B in the opposed end of the sticks 506B. The protrusion 586B and the groove 588B serve to guide the sticks 506B through the chute 516 of the delivery system 504 of FIG. 22.

Referring now to FIG. 26, yet another embodiment is shown as printer 602. The printer 602 includes a solid ink delivery system 604 which has a chute 616 which is different than the chute 516 of the printer 504 of FIG. 22. The chute 616 receives the sticks 606. The chute 616 includes a first linear portion 674 that forms an angle $\alpha\alpha\alpha$ with respect to the vertical and a second linear portion 676 that forms an angle $\beta\beta$ with the vertical. The first portion 674 and the second portion 676 form an angle $\theta$ there between.

Referring now to FIG. 27, another embodiment is shown as printer 702. The printer 702 includes a solid ink delivery system 704 which has a chute 716 which has three separate portions for advancing sticks 706. The chute 716 includes a first linear portion 774 that extends downwardly from loading position 720. An arcuate portion 784 connects the first linear portion 774 to a second linear portion 776 that extends downwardly to delivery position 722. The first linear portion 774 forms an angle $\alpha\alpha\alpha\alpha$ with respect to the vertical, while the second linear portion 776 forms an angle $\beta\beta\beta$ with respect to the vertical. The first linear portion 774 and the second linear portion 776 are connected by the arcuate portion 784 which defines an angle $\theta\theta$ there between as well as a radius RR extending from origin 726.

Variations and modifications of the system described herein are possible, given the above description. However, all variations and modifications which are obvious to those skilled in the art to which the system pertains are considered to be within the scope of the protection granted by this Letters Patent.

What is claimed is:

1. A solid ink delivery system for a solid ink printer comprising:

a chute having a first end and a second end, the chute having a solid ink stick insertion opening at the first end of the chute and the chute being arcuate over at least a portion of the chute between the first end and the second end;

a melting device positioned proximate the second end of the chute to melt at least a portion of a solid ink stick exiting the second end of the chute; and an endless belt mounted along a length of the chute between the first end and the second end of the chute, the endless belt being configured to engage at least one solid ink stick within the chute and to transport the solid ink stick along a portion of the chute.

2. The solid ink delivery system of claim 1 wherein at least a portion of the chute is helical.

3. The solid ink delivery system of claim 1, the endless belt being mounted along the arcuate portion of the chute and being arranged to remain in engagement with the solid ink stick as the solid ink stick is transported by the endless belt along the arcuate portion of the chute.

4. The solid ink delivery system of claim 1 wherein the chute is arcuate from the first end to the second end.

5. The solid ink delivery system of claim 1, the chute further comprising:

longitudinal openings to enable viewing of solid ink sticks in the chute.

6. The solid ink delivery system of claim 1 further comprising:

nudgers that bias solid ink sticks against the endless belt.

7. The solid ink delivery system of claim 6, the nudgers further comprising:

pinch rollers that are spring biased to urge the solid ink sticks against the endless belt.

8. A solid ink stick for use in a solid ink printer comprising:

a body having an upper surface, a bottom surface, a front face, a rear face, and two side surfaces with a length extending from the front face to the rear face, a width extending between the two side surfaces, and a height extending from the bottom surface to the upper surface, the length of the body being greater than the height of the body;

the upper surface being arcuate along a portion of the length of the upper surface of the body that extends between the front face and the rear face and the bottom surface being arcuate along a portion of the length of the bottom surface of the body that extends between the front face and the rear face; and a groove formed in the bottom surface at a position equidistant from the two side surfaces of the body.

9. The solid ink stick of claim 8 wherein the arcuate portion of the bottom surface of the body is parallel to the arcuate portion of the upper surface of the body.

10. The solid ink stick of claim 9 further comprising:

a first planar portion formed in the bottom surface of the body, the first planar portion being positioned between one end of the arcuate portion of the bottom surface and the front face; and a second planar portion formed in the bottom surface of the body, the second planar portion being positioned between another end of the arcuate portion of the bottom surface and the rear face so the arcuate portion of the bottom surface extends between the first planar portion and the second planar portion.

11. A solid ink delivery system for a solid ink printer comprising:

a chute having a first end and a second end, the chute having a solid ink stick insertion opening at the first end of the chute and the chute being arcuate over at least a portion of the chute between the first end and the second end;

a melting device positioned proximate the second end of the chute to melt at least a portion of a solid ink stick exiting the second end of the chute;

a drive member mounted along a length of the chute between the first end and the second end of the chute, the drive member being configured to engage at least one solid ink stick within the chute and to transport the solid ink stick along a portion of the chute; and a plurality of pinch rollers positioned along the chute, each pinch roller having a spring biasing member that moves the pinch roller against a surface of a solid ink stick and urges the solid ink stick against the drive member.

12. The solid ink delivery system of claim 11 wherein at least a portion of the chute is helical.

13. The solid ink delivery system of claim 11, the drive member further comprising:

an endless belt.

14. The solid ink delivery system of claim 11, the drive member being mounted along the arcuate portion of the chute and being arranged to remain in engagement with the solid ink stick as the solid ink stick is transported by the drive member along the arcuate portion of the chute.

15. The solid ink delivery system of claim 11 wherein the chute is arcuate from the first end to the second end.

16. The solid ink delivery system of claim 11, the chute further comprising:

longitudinal openings to enable viewing of solid ink sticks in the chute.

* * * * *